US007442478B2

(12) United States Patent
Itakura et al.

(10) Patent No.: US 7,442,478 B2
(45) Date of Patent: Oct. 28, 2008

(54) TONER AND METHOD FOR FORMING IMAGE

(75) Inventors: Takayuki Itakura, Shizuoka-ken (JP); Yuko Sato, Shizuoka-ken (JP); Hiroyuki Fujikawa, Kanagawa-ken (JP); Nobuyoshi Sugahara, Shizuoka-ken (JP); Hirohide Tanikawa, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/693,981

(22) Filed: Mar. 30, 2007

(65) Prior Publication Data

US 2007/0184372 A1 Aug. 9, 2007

Related U.S. Application Data

(62) Division of application No. 10/890,165, filed on Jul. 14, 2004, now Pat. No. 7,320,850.

(30) Foreign Application Priority Data

Jul. 14, 2003 (JP) ..... 2003-196708
Nov. 19, 2003 (JP) ..... 2003-389755

(51) Int. Cl.
*G03G 15/01* (2006.01)

(52) U.S. Cl. ..... 430/45.4; 430/45.1; 430/45.5

(58) Field of Classification Search ..... 430/45.4, 430/45.1, 45.5
See application file for complete search history.

(56) References Cited

U.S. PATENT DOCUMENTS 5,116,711 A 5/1992 Kobayashi et al. ..... 430/106
5,437,949 A 8/1995 Kanbayashi et al. ... 430/108.23
5,814,429 A 9/1998 Kawakami et al. ..... 430/124
5,842,080 A 11/1998 Ashibe et al. ..... 399/49
5,912,099 A 6/1999 Kanbayashi et al. ..... 130/106
5,912,101 A 6/1999 Karaki et al. ..... 430/110
6,013,403 A 1/2000 Ichikawa ..... 430/97
6,033,817 A 3/2000 Yusa et al. ..... 430/110.4
6,327,450 B1 12/2001 Ito ..... 399/227
6,498,910 B2 12/2002 Haneda ..... 399/51
6,586,147 B2 7/2003 Iida et al. ..... 430/45
6,670,087 B2 12/2003 Fujikawa et al. ..... 430/109.2

(Continued)

FOREIGN PATENT DOCUMENTS

EP 0827039 3/1998

(Continued)

*Primary Examiner*—Christopher RoDee
(74) *Attorney, Agent, or Firm*—Fitzpatrick, Cella, Harper & Scinto

(57) ABSTRACT

A magenta toner is provided which contains at least a binder resin, a colorant, and a wax, in which a maximum heat-absorption peak temperature as measured using a differential scanning calorimeter, a reflectance at a predetermined wavelength when measured in a powder state by spectroscopic analysis, and lightness when measured in a powder form are in specific ranges. A full-color image is formed using the magenta toner as a pale magenta toner in combination with a deep magenta toner. According to the present invention, it becomes possible to form a vivid image which has reduced graininess and roughness from a low-density region to a high-density region, ensures a sufficient fixing temperature region, has a color reproduction range wider that the conventional one, and has high transparency on an OHP sheet.

5 Claims, 11 Drawing Sheets

U.S. PATENT DOCUMENTS

| | | | | |
|---|---|---|---|---|
| 6,673,506 | B2 | 1/2004 | Nakanishi et al. | 430/137.18 |
| 6,996,358 | B2 * | 2/2006 | Ayaki et al. | 430/45.4 |
| 2002/0037466 | A1 | 3/2002 | Kanbayashi et al. | 430/108.23 |
| 2003/0134215 | A1 | 7/2003 | Kashiwabara et al. | 430/108.4 |
| 2003/0207186 | A1 | 11/2003 | Itakura et al. | 430/45 |
| 2004/0009420 | A1 | 1/2004 | Sugahara et al. | 430/108.1 |
| 2004/0175642 | A1 | 9/2004 | Ida et al. | 430/109.4 |
| 2004/0209178 | A1 | 10/2004 | Itakura et al. | 430/45 |
| 2006/0134543 | A1 | 6/2006 | Kashiwabara et al. | 430/109.3 |

FOREIGN PATENT DOCUMENTS

| | | |
|---|---|---|
| EP | 1376255 | 1/2004 |
| JP | 61/118759 | 6/1986 |
| JP | 03-261960 | 11/1991 |
| JP | 03-261961 | 11/1991 |
| JP | 11-84764 | 3/1999 |
| JP | 2000/056509 | 2/2000 |
| JP | 2000-231279 | 8/2000 |
| JP | 2000-305339 | 11/2000 |
| JP | 2000-347476 | 12/2000 |
| JP | 2001-249492 | 9/2001 |
| JP | 2001/249497 | 9/2001 |
| JP | 2001-290319 | 10/2001 |
| JP | 2001/356526 | 12/2001 |
| JP | 2002/108022 | 4/2002 |
| JP | 2002/182431 | 6/2002 |
| JP | 2002/341606 | 11/2002 |
| JP | 2003-005424 | 1/2003 |
| JP | 2003-057876 | 2/2003 |
| JP | 2003-076065 | 3/2003 |

* cited by examiner

TONER AND METHOD FOR FORMING IMAGE

This application claims priority from Japanese Patent Application Nos. 2003-196708 filed Jul. 14, 2003, and 2003-389755 filed Nov. 19, 2003, which are hereby incorporated by reference.

BACKGROUND OF THE INVENTION

1. Field of the Invention

The present invention relates to a toner for developing an electrostatic image through a method for forming an image such as electrophotography and electrostatic printing, or a toner for forming toner images through a method for forming an image of a toner jet process, a method for forming an image, and a method for forming a full-color image. More specifically, the present invention relates to a toner employed in a fixing process in which those toner images are fixed under heating and pressure onto a transfer material such as a print sheet, a method for forming an image, and a method for forming a full-color image.

2. Description of the Related Art

As a color image forming apparatus of an electrophotographic process is spread widely, its use has also prevailed in wide variety, leading to a severe demand on image quality. An extremely fine and faithful reproduction of even fine portions has been demanded for a copy of an image such as general photographs, catalogs, and maps. Along with this demand, a demand toward vividness of color has increased, and an extension of color reproduction range is desired. In particular, adoption of such an image forming apparatus has been remarkably expanding in the field of printing, so that a high level of colorfulness, fineness, graininess, etc. equal to or higher than a print quality is demanded for the electrophotographic process as well.

In a recent image forming apparatus of an electrophotographic process employing digital image signals, dots of a constant potential gather on the surface of a latent image bearing member, that is, a photosensitive member to form a latent image, and solid portions, halftone portions, and line portions are expressed by changing a dot density.

However, in this method, a problem tends to occur in that gradation of a toner image corresponding to a ratio of the dot densities of black portions and white portions of the digital latent image cannot be obtained because toner particles are hardly deposited on the dot faithfully and they fall out of the dot. Further, when enhancing resolution by reducing a dot size to improve the image quality, it becomes more difficult to reproduce the latent image formed with minute dots. In addition, an image poor in resolution and in gradation of a highlight portion, in particular, and lacking in sharpness tends to be obtained. Further, irregular dot arrangement is perceived as graininess and becomes a cause of degrading the image quality of the highlight portion.

A method for forming an image, employing a deep color toner (deep toner) for the solid portion and a toner with lower density (pale toner) for the highlight portion, is proposed for alleviating the above problem.

For instance, a method for forming an image employing a plurality of toners with different densities combined has been known (see, for example, JP 11-084764 A and JP 2000-305339 A). Further, JP 2000-347476 A proposes an image forming apparatus combining a pale toner having the maximum reflection density of half or less of the maximum is reflection density of a deep toner.

In addition, JP 2000-231279 A proposes an image forming apparatus combining a deep toner having an image density, with a toner amount of 0.5 mg/cm$^2$ on a transfer material, of 1.0 or more and a pale toner having the image density below 1.0. Further, JP 2001-290319 A discloses an image forming apparatus combining toners with a slope ratio of recording densities of a deep toner and a pale toner between 0.2 and 0.5.

Studies of the inventors of the present invention have found out that those conventional techniques may improve the gradation and mitigate the graininess in a low-density region consisting of the pale toner alone, but cannot provide sufficiently satisfactory graininess in a medium-density region where the deep toner and the pale toner are mixed. In addition, those techniques leave some room for contrivances to extend a color reproduction range.

Although some of the publications published up to now included descriptions relating to a method for forming an image using a pale toner, none of the publications described an optimum design of hue and density of a colorant for the pale toner and an effect of the kind and amount of a wax on mitigation of the graininess (roughness) of an image in the low-density region and on expansion of a fixing temperature region.

SUMMARY OF THE INVENTION

An object of the present invention is to provide a magenta toner capable of solving problems of the above conventional techniques, a method for forming an image, and a method for forming a full-color image.

That is, an object of the present invention is to provide a magenta toner capable of forming an image with reduced graininess and roughness from a low-density region to a high-density region and ensuring a sufficient fixing temperature range, a method for forming an image, and a method for forming a full-color image.

Another object of the present invention is to provide a magenta toner capable of forming a vivid image having a wider color reproduction range and higher transparency on OHP sheets compared to images formed through conventional methods, a method for forming an image, and a method for forming a full-color image.

The above objects can be attained by selecting the hue, lightness and various materials to be used of a magenta toner in a balanced manner. That is, the present invention is established by the following compositions.

That is, the present invention is a magenta toner comprising magenta toner particles which comprises at least a binder resin, a colorant, and a wax, wherein: the magenta toner has one or plural heat-absorption peaks in a temperature range of 30 to 200° C. in a heat-absorption curve obtained using a differential scanning calorimeter, and a maximum value of a maximum heat-absorption peak in the one or plural heat-absorption peaks is in a range of 65 to 105° C.; the magenta toner when measured in a powder form by spectroscopic analysis has a reflectance of 15 to 45% at a wavelength of 480 nm and a reflectance of 65 to 90% at a wavelength of 630 nm; and the magenta toner when measured in a powder form has a lightness L* of 45 to 75.

In addition, the present invention relates to a method for forming an image, comprising: forming a first electrostatic charge image on an electrostatic charge image bearing member; forming a first magenta toner image by developing the first electrostatic charge image with a first magenta toner; transferring the first magenta toner image to a transfer material through an intermediate transfer member or directly; forming a second electrostatic charge image on the electrostatic charge image bearing member, forming a second magenta toner image by developing the second electrostatic charge image with a second magenta toner; transferring the second magenta toner image to the transfer material through the intermediate transfer member or directly; and fixing the first magenta toner image and the second magenta toner image on the transfer material under heating and pressure to form a fixed image on the transfer material, wherein: the first magenta toner comprises one of a pale magenta toner and a deep magenta toner; and the second magenta toner comprises the other of the pale magenta toner and the deep magenta toner; and the pale magenta toner comprises magenta toner particles which comprises at least a binder resin, a colorant, and a wax, has one or plural heat-absorption peaks in a temperature range of 30 to 200° C. in a heat-absorption curve obtained using a differential scanning calorimeter, has a maximum value of a maximum heat-absorption peak temperature in the one or plural heat-absorption peaks in a range of 65 to 105° C., has a reflectance of 15 to 45% at a wavelength of 480 nm and a reflectance of 65 to 90% at a wavelength of 630 nm when measured using the magenta toner in a powder form by spectroscopic analysis, and has a lightness L* of 45 to 75 when measured in a powder form.

Further, the present invention relates to a method for forming a full-color image, comprising forming a first electrostatic charge image on an electrostatic charge image bearing member; forming a first toner image by developing the first electrostatic charge image with a first toner selected from the group consisting of a cyan toner, a yellow toner, a pale magenta toner, a deep magenta toner, and a black toner; transferring the first toner image to a transfer material through an intermediate transfer member or directly; forming a second electrostatic charge image on the electrostatic charge image bearing member; forming a second toner image by developing the second electrostatic charge image with a second toner selected from the group consisting of a cyan toner, a yellow toner, a pale magenta toner, a deep magenta toner, and a black toner and excluding the first toner; transferring the second toner image to the transfer material through the intermediate transfer member or directly; forming a third electrostatic charge image on the electrostatic charge image bearing member; forming a third toner image by developing the third electrostatic charge image with a third toner selected from the group consisting of a cyan toner, a yellow toner, a pale magenta toner, a deep magenta toner, and a black toner and excluding the first toner and the second toner; transferring the third toner image to the transfer material through the intermediate transfer member or directly; forming a fourth electrostatic charge image on the electrostatic charge image bearing member; forming a fourth toner image by developing the fourth electrostatic charge image with a fourth toner selected from the group consisting of a cyan toner, a yellow toner, a pale magenta toner, a deep magenta toner, and a black toner and excluding the first to third toners; transferring the fourth toner image to the transfer material through the intermediate transfer member or directly; forming a fifth electrostatic charge image on the electrostatic charge image bearing member; forming a fifth toner image by developing the fifth electrostatic charge image with a fifth toner selected from the group consisting of a cyan toner, a yellow toner, a pale magenta toner, a deep magenta toner, and a black toner and excluding the first to fourth toners; transferring the fifth toner image to the transfer material through the intermediate transfer member or directly; and forming an image by fixing under heating and pressure the transfer material on which toner images of the yellow toner, the pale magenta toner, the deep magenta toner, and the black toner are formed, wherein the pale magenta toner comprises magenta toner particles which comprises at least a binder resin, a colorant, and a wax, has one or plural heat-absorption peaks in a temperature range of 30 to 200° C. in a heat-absorption curve obtained using a differential scanning calorimeter, has a maximum value of a maximum heat-absorption peak of the one or plural heat-absorption peaks in a range of 65 to 105° C., has a reflectance of 15 to 45% at a wavelength of 480 nm and a reflectance of 65 to 90% at a wavelength of 630 nm when measured using the magenta toner in a powder form by spectroscopic analysis, and has a lightness L* of 45 to 75 when measured in a powder form.

According to the present invention, there is provided a magenta toner comprising at least a binder resin, a colorant, and a wax, in which thermal properties as measured by differential thermal analysis measurement and spectral optical properties as measured by spectroscopic analysis are determined as appropriate. Therefore, the use of the magenta toner allows the formation of an image which has reduced graininess and roughness from a low-density region to a high-density region and which ensures a sufficient fixing temperature range.

In addition, according to the present invention, a vivid image having a wider color reproduction range and higher transparency on OHP sheets compared to images formed through conventional methods can be formed.

DETAILED DESCRIPTION OF THE PRESENT INVENTION

Figure 1:
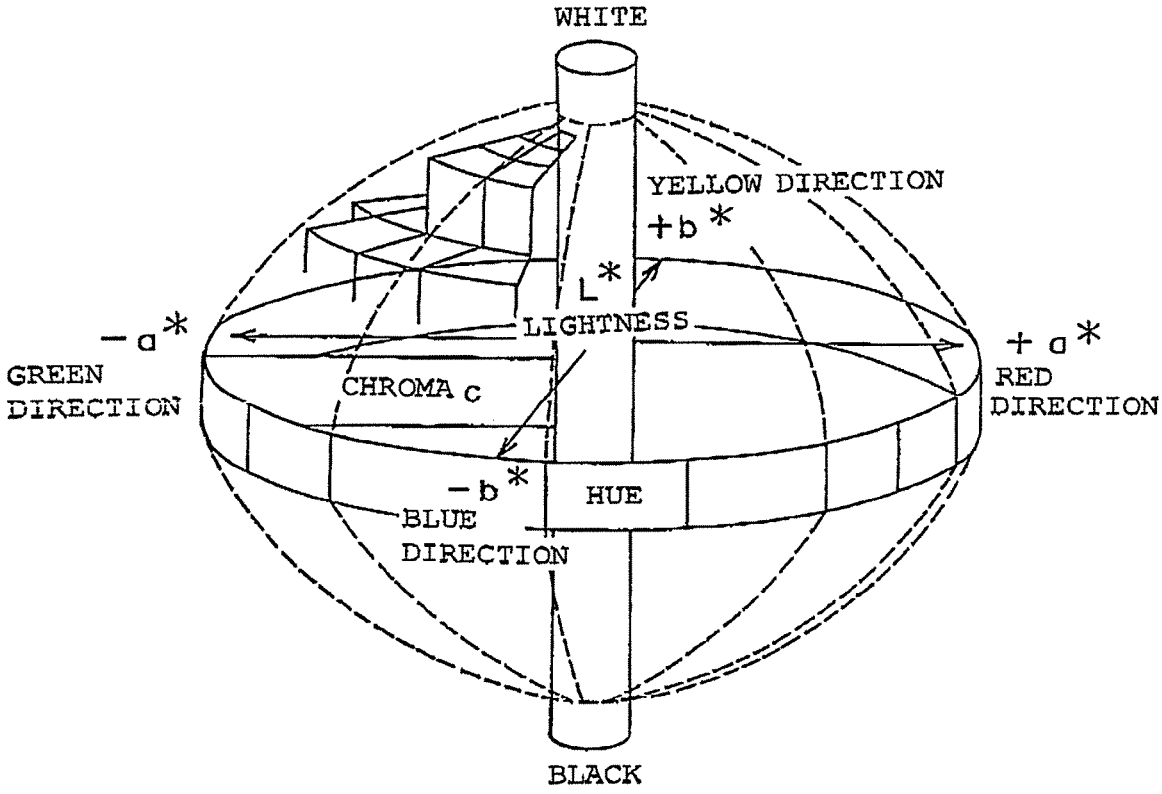
FIG. 1 is a diagram showing a concept of an L*a*b*colorimetric system three-dimensionally.

In general, a*, b*, and L* values of the color toner and the image are values used in an L*a*b*colorimetric system, a useful means of expressing color through digitalization. FIG. 1 shows a three-dimensional conceptual diagram of the L*a*b*colorimetric system. In FIG. 1, horizontal axes a* and b* both represent hue. The hue measures a tone such as red, yellow, green, blue, and violet. A vertical axis L* represents lightness, showing a degree of color lightness comparable irrespective of the hue. Each of the a* and b* axes represents a direction of color, and the a* axis represents a red-green direction and the b* axis represents a yellow-blue direction. Further, the c* value represents chroma, showing a degree of vividness of color, and is determined using the following equation.

$$c^* = \sqrt{a^{*2} + b^{*2}}$$

Used in the present invention is a magenta toner comprising at least a binder resin, a colorant, and a wax, the magenta toner having one or plural heat-absorption peaks in the temperature range of 30 to 200° C. in a heat-absorption curve obtained through differential scanning calorimetry (DSC) of the magenta toner, a maximum value of the maximum heat-absorption peak in the heat-absorption peaks being in the range of 65 to 105° C., the magenta toner in a powder form having reflectance in the range of 15 to 45% at a wavelength of 480 nm and reflectance in the range of 65 to 90% at a wavelength of 630 nm in a spectral distribution diagram the axis of ordinate of which indicates reflectance (%) and the axis of abscissa of which indicates a wavelength (nm), and an L* value measured in a powder form being in the range of 45 to 75. The magenta toner of the present invention solves the problems described above and provides a good image without graininess particularly in a low-density region, with excellent gradation, and having a wide color reproduction range. The magenta toner of the present invention may be used in any manner without any particular limitations as long as the above properties are satisfied. However, the above-mentioned effect of the magenta toner of the present invention becomes even better when used as a pale toner in combination with a deep toner. In the present invention, a pale toner and a deep toner represent a toner with high lightness and a toner with low lightness, respectively, and are not necessarily limited to implications of pale color and deep color.

The reason is described below as to why such an effect can be achieved using the magenta toner having such properties.

In general, a color gamut highly sensitive to the human eye and a color gamut relatively lowly sensitive to the human eye exist in color hue. The colors highly sensitive to the human eye are colors of cold colors from blue to dark blue, and the gradation of those colors is easily recognized even in a high-density region with a small rate of change of the image density. However, the colors have a characteristic in that variations of dots and lines are easily perceived as graininess (roughness) in a low-density region where the toner exists as dots and lines in the image. On the other hand, the graininess of the colors of warm colors from yellow to flesh color is hardly recognized by the human eye even in a low-density region with a large rate of change of the image density. Colors from skin color to red are highly sensitive to the human eye, and have a characteristic in that variations of dots and lines are easily perceived as graininess (roughness) in a low-density region where the toner exists as dots and lines in the image.

The present invention relates to graininess improvement in the low-density region of the colors of skin color to red, which are relatively highly sensitive to the human eye in all density regions. In the present invention, spectral sensitivity distribution of the magenta toner itself in a powder form is measured for investigating the roughness and the graininess of an image. The reason is described below for defining spectral sensitivity characteristics of the toner in a powder form before being fixed instead of the spectral sensitivity characteristics of the image after the fixation of the toner.

Various fixing devices and transfer materials exist, and the gloss and color gamut expressed change widely according to the conditions and combinations of the fixing devices and the transfer materials. Further, fixing conditions such as pressure, temperature, and a nip width of the fixing device change crushing of the toner, and the change poses influences on the graininess (roughness) on an image. Those influences were found to appear more remarkably in the low-density region. In view of this, in the present invention, various spectral sensitivity characteristics of the toner in a powder form are studied in order to obtain an image with mitigated graininess of the low-density image without influences of a structure of the fixing device and the transfer materials.

The present invention can provide an image with little graininess (roughness) and a wide color reproduction range by controlling kinds, amounts, and dispersion forms of a colorant and a wax added to the toner and adjusting reflectance at respective wavelengths and lightness within a range defined by the present invention.

Reflectance values at 480 nm and 630 nm in the spectral sensitivity distribution of the toner in a powder form is an index of a color gamut zone reproducible by the magenta toner which reproduces skin to red colors. If the reflectance at each wavelength is small, the variation of dots and lines tends to be easily perceived as graininess (roughness). Theoretically, larger reflectance values at wavelengths of 480 nm and 630 nm can provide even wider two-dimensional color reproduction planes. However, a too large value increases a total amount of the magenta toner even if the toner of the present invention is provided as a pale toner and combined with a deep toner, thereby degrading fixability.

Therefore, a magenta toner similar to the toner of the present invention, having a reflectance of 15 to 45% at a wavelength of 480 nm and 65 to 90% at a wavelength of 630 nm obtained through spectral analysis measurement of the magenta toner in a powder form, must be used for obtaining a fixed image with little graininess using a relatively small amount of the magenta toner, particularly in a low-density. With the magenta toner having the reflectance lower than 15% at a wavelength of 480 nm and lower than 65% at a wavelength of 630 nm, the graininess of the image is noticeable in the low-density region where the toner exists as dots and lines in the image. In addition, the smooth gradation of halftone as a photograph is hardly obtained, and image chroma may be significantly degraded. Further, with the magenta toner having the reflectance higher than 45% at a wavelength of 480 nm and higher than 90% at a wavelength of 630 nm, a total amount of the toner used for reproducing relatively high-density halftone in the low-density region becomes too large and thus sufficient fixability may not be obtained. To obtain a magenta toner capable of forming an image with low graininess and smooth gradation and having good fixability, the reflectance at a wavelength of 480 nm is preferably in the range of 18 to 48% in the spectral analysis measurement in a powder form. From the same viewpoint, the reflectance at a wavelength of 630 nm is preferably in the range of 68 to 85%.

The reflectance can be adjusted by controlling: the kind and thermal property of the wax used or of a wax dispersion medium; the kind and particle size distribution of the colorant; and viscoelastic property of the toner.

Controlling the reflectance only with an amount of the colorant added causes an increase in roughness of the fixed image while narrowing a fixing range, degrading the transparency on an OHP sheet, and lowering the chroma of an output image. This is because the dispersion forms of the colorant and the wax in the toner particles cannot be controlled into appropriate forms.

In addition, the magenta toner of the present invention is characterized in that the reflectance is within the above range and lightness L*(a) measured in a powder form is in the range of 45 to 75. The lightness L*(a) is preferably in the range of 48 to 70 for exerting a better effect of the present invention of providing good fixability while reducing graininess of a fixed Image. An L* value of the magenta toner measured using the magenta toners in a powder form is highly sensitive to the human eye similar to a* and b* values. If the L* value is below 45, an effect of reducing the graininess is lowered in the medium-density zone continuing from the low-density region to the high-density region, and a three-dimensional color reproduction space may be degraded in a full-color image. On the other hand, if the L* value is above 75, a total amount of the toner used for reproducing relatively high density halftone in the low density region becomes too large, and thus, sufficient fixability may not be obtained. The lightness L* of the magenta toner in a powder form can be adjusted by controlling the kind and thermal property of the wax and the wax dispersant used and the kind and the particle size distribution of the colorant.

Controlling the lightness L* only with an amount of the colorant added causes an increase in roughness of an image while narrowing the fixing range, degrading the transparency on an OHP sheet, and lowering the chroma of an output image. This is because optimum dispersion forms of the colorant and the wax in the toner cannot be obtained.

Combined use of the magenta toner of the present invention as a pale toner with an appropriate deep toner is preferable compared to using the magenta toner independently. The combination of the toners allows attaining image reproduction without roughness in the low-density region, reproduction of a smooth halftone image from the low-density region to the high-density region, and satisfactory fixability. In such case, the lightness L*(a) of the magenta toner of the present invention as the pale magenta toner and the lightness L*(b) of the deep magenta toner preferably satisfy a relationship represented by the following expression.

$$10 \leqq L^*(a) - L^*(b) \leqq 30$$

A value of L*(a)−L*(B) mentioned above is preferably in the range of 12 to 27.

If a value of L*(a)−L*(B) is below 10, a three-dimensional color reproduction space may be largely degraded in a full-color image. On the other hand, if the value of L*(a)−L*(b) is above 30, a total amount of the toner used becomes too large, and thus sufficient fixability may not be obtained, which is not preferable. L*(b) may be adjusted according to a method similarly to that for L*(a) described above.

As described above, defining the spectral properties of the magenta toner in a powder form as described above is a useful means for achieving an image without noticeable graininess in the low-density region, with the smooth gradation of halftone as a photograph, and with satisfactory chroma. Further, the inventors of the present invention have found out that the kind and amount of the wax comprised in the magenta toner are important factors for combining high image quality described above with necessary and sufficient fixability.

That is, the inventors of the present invention have found out that the effect of the present invention cannot be sufficiently exerted only by reducing an amount of colorant added and the effect of the present invention can be exerted by using the toner having the following composition.

Hereinafter, a preferable toner composition with which the effect of the present invention can be fully exerted will be described below.

The magenta toner must comprise a wax in addition to a binder resin and a colorant for obtaining an output fixed image with satisfactory chroma and suppressed roughness (graininess) in the low-image density region. In particular, the wax is added into the magenta toner particles when using a fixing device without any oil application or a fixing device under with minute oil application.

The magenta toner of the present invention has such a feature in that a heat-absorption curve of differential scanning calorimetry (DSC) has one or plural heat-absorption peaks in the temperature range of 30 to 200° C. and a maximum value of the maximum heat-absorption peak of the one or plural heat-absorption peaks in the range of 65 to 105° C. Further, the maximum value of the maximum heat-absorption peak of the heat-absorption peaks is more preferably in the range of 70 to 100° C. The maximum value of the magenta toner can be adjusted according to the kind or amount of the wax used.

If the maximum value of the maximum heat-absorption peak is below 65° C., the wax melts at the toner surface when the toner is left in a high temperature environment. Therefore, anti-blocking property may be largely degraded while a fused product may strongly adhere to a drum. In addition, the melting and exudation amounts of the wax when the toner is fixed at high temperature fixation are low, so that high temperature offset property may be degraded. On the other hand, if the maximum value of the maximum heat-absorption peak is above 105° C., the wax cannot migrate to the molten toner surface rapidly when the toner is fixed at low temperature. If the toner having high lightness (L*) is used for mitigating the graininess in the low-density region, a total amount of the toner used for the fixing increases, thereby more easily causing high temperature offset.

The inventors of the present invention have made extensive studies to find out the following. When adopting a non-contact fixing system such as oven fixing and flash fixing for a fixing system, a satisfactory fixed image can be obtained with excellent gradation and without graininess (roughness) from the low-density region to the high-density region by only suppressing a tone of the magenta toner in a powder form. However, a material composition shown in the present invention is extremely important when using a contact fixing system such as a roller or a belt without oil application or with minute oil application on the surface of the roller or the belt, particularly.

Further, the inventors of the present invention have found out that when forming continuous full-color images at high speed by combining the deep and pale toners, satisfactory fixing property may be obtained if the following requirements are satisfied regarding not only melting property of the wax but also viscoelastic property of the toner.

That is, the preferable elastic property of the magenta toner of the present invention (pale magenta toner) includes a storage elastic modulus (G'120) in the range of $5\times10^2$ to $1\times10^5$ [Pa] at a temperature of 120° C. and a storage elastic modulus (G'180) in the range of 10 to $5\times10^3$ [Pa] at a temperature of 180° C. Further, the magenta toner has G'120 of preferably $6\times10^2$ to $9\times10^4$ [Pa], and more preferably $7\times10^2$ to $8\times10^4$ [Pa]. Further, the magenta toner has G'180 of preferably 20 to $4\times10^3$ [Pa], and particularly preferably 30 to $3\times10^3$ [Pa].

If the magenta toner has G'120 below $5\times10^2$ [Pa], twining of a transfer material to a fixing roller becomes remarkable when the fixing temperature is high in the case where a large amount of the toner must be fixed like the present invention. Further, if the magenta toner has G'180 below 10 [Pa], offset to the fixing roller occurs, narrowing the fixing region at higher temperatures when a large amount of the toner is loaded on the transfer material like the present invention.

On the other hand, if the magenta toner has G'120 above $1\times10^5$ [Pa], offset to the fixing roller tends to occur when fixing temperature is low. When a large amount of the toner is loaded on a transfer material for fixing as in the present invention, heat is not sufficiently transmitted to a lower layer of the toner near the transfer material, thereby extremely narrowing the fixing region at lower temperatures. Further, if the magenta toner has G'180 above $5\times10^3$ [Pa], gloss of an image during fixing reduces, and the image quality of the image degrades.

The storage elastic moduli can be adjusted by, for example, the kind, amount, and degree of crosslinking of the binder resin used.

When using the pale magenta toner of the present invention and a deep magenta toner at the same time, the viscoelastic property of the deep toner is preferably in the above range from the viewpoints of anti-offset property and low temperature fixability.

Further, it is preferable that the magenta toner of the present invention has a deformation rate (R200) of 45 to 65%, measured by applying a pressure of $4.0\times10^3$ Pa at 120° C. to a sample of the toner pressed into a pellet form. The deformation rate R200 of the toner is more preferably 47 to 63%, and most preferably 48 to 62%. Further, the magenta toner of the present invention has a deformation rate (R500) of 65 to 85%, measured by applying a pressure of $1.0\times10^4$ Pa at 120° C. to a sample of the toner in a pellet form. The deformation rate (R500) is more preferably 67 to 82%, and most preferably 68 to 81%.

If the deformation rate (R200) is far below 45%, a high definition image is hardly obtained because the toner is not crushed while the transfer material, with the toner transferred thereto, passes through the fixing device and the toner scatters around the image. In particular, such problem noticeably arises when expressing an image density by loading a large amount of the toner on the transfer material as in the present invention. Further, if the deformation rate (R500) is below 65%, gloss becomes uneven in places using a large amount of the pale magenta toner and using a large amount of the deep magenta toner, when using the toner of the present invention as the pale magenta toner and combining it with the deep magenta toner. Thus, the image quality is easily degraded.

If the deformation rate (R200) exceeds 65%, development of an image is obstructed and durability of the toner is degraded because the toner itself is soft, thereby lowering transfer efficiency. Further, if the deformation rate (R500) exceeds 85%, the toner is excessively crushed on the image. The image easily blurs when a large amount of the toner is loaded, and the roughness of the image appears. Adjustment of each of R200 and R500 of the toner of the present invention in the above range is ascribable to preparation of the toner. To be specific, the toner obtained through pulverization depends on temperature and share during kneading. The deformation rate can also be adjusted with a molecular weight of a resin or addition of a crosslinking agent or the like.

The magenta toner of the present invention may comprise one or two or more kinds of waxes. Furthermore, the magenta toner of the present invention preferably comprises at least a hydrocarbon-based wax. Adding at least a hydrocarbon-based wax in the toner produces satisfactory affinity between the colorant and the wax. As a result, the toner in a form containing a finely dispersed colorant can be obtained with satisfactory transparency on an OHP sheet in the low-density region.

Examples of the wax used in the present invention include: an aliphatic hydrocarbon-based wax such as low molecular weight polyethylene, low molecular weight polypropylene, olefin, micro crystalline wax, paraffin wax, and Fischer-Tropsch wax; oxide of an aliphatic hydrocarbon-based wax such as polyethylene oxide wax; a block copolymer thereof; wax comprised an ester of fatty acid mainly such as carnauba wax, montanic acid ester wax; and waxes such as deoxidized carnauba wax in which the aliphatic ester is partly or fully deoxidized.

Furthermore, the examples further include: saturated normal chain fatty acids such as palmitic acid, stearic acid, montanic acid; unsaturated fatty acids such as brassidic acid, eleostearic acid, and parinaric acid; saturated alcohols such as stearyl alcohol, aralkyl alcohol, behenyl alcohol, carnaubyl alcohol, seryl alcohol, melissyl alcohol; polyhydric alcohols such as sorbitol; fatty acid amides such as linoleic acid amide, oleic acid amide, and lauric acid amide; saturated fatty acid bisamides such as methylenebis stearic acid amide, ethylenebis capric acid amide, ethylenebis lauric acid amide, and hexamethylenebis stearic acid amide; unsaturated fatty acid amides such as ethylenebis oleic acid amide, hexamethylenebis oleic acid amide, N,N'-dioleyl adipic acid amide, and N,N'-dioleyl sebacic acid amide; aromatic bisamides such as m-xylenebis stearic acid amide, and N,N'-distearyl isophthalic acid amide; aliphatic metallic salts (generally known as metallic soap) such as calcium stearate, calcium laurate, zinc stearate, and magnesium stearate; waxes prepared by grafting an aliphatic hydrocarbon-based wax using a vinyl-based monomer such as styrene or acrylic acid; partially esterificated material of a fatty acid and a polyhydric alcohol such as behenic acid monoglyceride; and a methylester compound having a hydroxyl group, obtained by hydrogenation of the vegetable oil and fat.

The particularly preferred wax to be used in the present invention is an aliphatic hydrocarbon-based wax Preferred examples of the wax include: a low-molecular-weight olefin polymer obtained by radical polymerization of an olefin under a high pressure or by polymerization of an olefin with a Ziegler catalyst or a metallocene catalyst under a low pressure; Fisher-Tropsch wax synthesized from coal or natural gas; an olefin polymer obtained by thermal decomposition of a high-molecular-weight olefin polymer; and a synthetic hydrocarbon wax obtained from a distillation residue of a hydrocarbon obtained from a synthetic gas containing carbon monoxide and hydrogen by the Arge method, or a synthetic hydrocarbon wax obtained by hydrogenation thereof.

Furthermore, a hydrocarbon wax after fractionation by using press-sweating method, solvent processing method, vacuum distillation, or fractional crystallization system is more preferably used.

A hydrocarbon as a matrix of a hydrocarbon-based wax concludes one synthesized by a reaction between carbon monoxide and hydrogen using a metal oxide catalyst (mostly, used as a multi-element system of two or more kinds of elements) (e.g., a hydrocarbon compound synthesized by a synthol process, and a hydrocol process (e.g., using a fluid catalyst bed)); hydrocarbons having approximately several hundreds of carbon atoms as an upper limit obtained by the Arge process (using identification catalyst bed), with which a number of wax-like hydrocarbons are obtained; and hydrocarbons prepared by polymerizing alkylene such as ethylene using a Ziegler catalyst; and paraffin wax. These hydrocarbons are preferable because they are straight hydrocarbons having a long saturated portion with a little branching. In particular, a wax synthesized without using polymerization of alkylene is preferred also in terms of its molecular weight distribution. In a molecular weight distribution of the wax, a main peak is present in the molecular weight range of preferably 350 to 2,400, and more preferably 400 to 2,000. Such a molecular weight distribution can impart preferable thermal properties to the toner. The molecular weight distribution of the wax can be adjusted by the kind of the wax used and the production conditions of the wax.

A general production step for full-color toner includes: a first kneading step (so-called masterbatch process) of forming a finely dispersed colorant composition (referred to as "first kneaded product"); and the first kneaded product and other materials is mixed at a second kneading step. In the present invention, the wax may be simultaneously added with a binder and other materials in the second kneading step. However, a "wax dispersant" prepared by finely dispersing a wax in a resin composition in advance is preferably used for finely dispersing the colorant in the toner better and mitigating the graininess in the low-density region.

To be specific, a wax dispersant comprises a wax dispersed in a wax dispersion medium and has enhanced dispersibility of the wax in the binder resin.

The wax dispersion medium is a reaction product of polyolefin and a vinyl-based polymer and is preferably a grafted product comprising polyolefin grafted with a vinyl-based polymer. Further, a "wax dispersion medium masterbatch" form, produced by melting and mixing the obtained the wax dispersant with the binder resin at a suitable ratio in advance, is more preferable because the dispersion of the colorant is improved in the second kneading step.

Examples of a vinyl monomer which can be used to obtain the vinyl-based polymer composes the wax dispersion medium include: styrene; styrene-based monomers which are styrene derivatives such as o-methyl styrene, m-methyl styrene, p-methyl styrene, p-methoxy styrene, p-phenyl styrene, p-chlorostyrene, 3,4-dichlorostyrene, p-ethyl styrene, 2,4-dimethyl styrene, p-n-butyl styrene, p-tert-butyl styrene, p-n-hexyl styrene, p-n-octyl styrene, p-n-nonyl styrene, p-n-decyl styrene, and p-n-dodecyl styrene; methacrylic acid-based monomers which are α-methylene aliphatic mono-carboxylic esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethyl amino ethyl methacrylate, and diethyl amino ethyl methacrylate; acrylic acid-based monomers which are acrylic esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; nitrogen-containing vinyl monomers like nitrogen-containing acrylic or methacrylic derivatives such as acrylonitrile, methacrylonitrile, and acrylamide. These compounds may be used alone or in combination.

Furthermore, there are included: unsaturated dibasic acids such as maleic acid, citraconic acid, itaconic acid, alkenyl succinic acid, fumaric acid, and mesaconic acid; anhydrides of unsaturated dibasic acids such as maleic anhydride, citraconic anhydride, itaconic anhydride, and alkenyl succinic anhydride; half esters of unsaturated dibasic acids such as maleic methyl half ester, maleic ethyl half ester, maleic butyl half ester, citraconic methyl half ester, citraconic ethyl half ester, citraconic butyl half ester, itaconic methyl half ester, alkenyl succinic methyl half ester, fumaric methyl half ester, and mesaconic methyl half ester; esters of unsaturated dibasic acids such as dimethyl maleate and dimethyl fumarate; α,β-unsaturated acids such as acrylic acid, methacrylic acid, crotonic acid, and cinnamic acid; α,β-unsaturated acid anhydrides such as crotonic anhydride and cinnamic anhydride: amhyrides of α,β-unsaturated acids and lower fatty acid; and monomers including carboxylic group such as alkenyl malonic acid, alkenyl glutaric acid, and alkenyl adipic acid, anhydrides of these, and monoesters of these.

Furthermore, there are included: esters of acrylic acid or methacrylic acid such as 2-hydroxyethyl acrylate, 2-hydroxyethyl methacrylate, and 2-hydroxypropyl methacrylate; and monomers which has hydroxy groups such as 4-(1-hydroxy-1-methylbutyl)styrene and 4-(1-hydroxy-1-methylhexyl)styrene. Of those described above, a copolymer of styrene and (meth)acrylate containing nitrogen is particularly preferable as the vinyl-based polymer.

The polyolefin to be reacted with the vinyl-based polymer preferably has a maximum value of the maximum heat-absorption peak of 80 to 140° C. during a temperature increase on a heat-absorption curve measured by DSC.

If the maximum value of the maximum heat-absorption peak of the polyolefin is below 80° C. or above 140° C., a branched structure (graft) with the copolymer synthesized using a vinyl monomer is lost. Therefore, fine dispersion of the hydrocarbon-based wax is not performed and segregation of the hydrocarbon-based wax easily occurs during production of the toner, possibly resulting in an image failure such as void. Examples of the polyolefin include polyethylene and an ethylene-propylene copolymer. Of those, low-density polyethylene is particularly preferably used in terms of reaction efficiency.

When using the low-density polyethylene for the polyolefin, a graft polymer of polyethylene and a vinyl-based polymer can be produced, for example, by melting the low-density polyethylene in xylene and adding a vinyl monomer to a xylene solution of the low-density polyethylene under heating for a reaction.

The wax dispersion medium preferably has a weight average molecular weight (Mw) of 5,000 to 100,000, and a number average molecular weight (Mn) of 1,500 to 15,000 in the molecular weight distribution measured by gel permeation chromatography (GPC) A ratio (Mw/Mn) of the weight average molecular weight (Mw) to the number average molecular weight (Mn) is preferably 2 to 40.

If the weight average molecular weight (Mw) of the wax dispersion medium is below 5,000, the number average molecular weight (Mn) of the wax dispersion medium is below 1,500, or the ratio (Mw/Mn) of the weight average molecular weight (Mw) to the number average molecular weight (Mn) is below 2, the anti-blocking property of the toner may be affected.

If the weight average molecular weight (Mw) of the wax dispersion medium is above 100,000, the number average molecular weight (Mn) of the wax dispersion medium is above 15,000, or the ratio (Mw/Mn) of the weight average molecular weight (Mw) to the number average molecular weight (Mn) is above 40, the wax finely dispersed in the wax dispersion medium cannot migrate to the surface of the fused toner rapidly during fixing, thereby not exhibiting a sufficient effect of the wax.

The molecular weight distribution of the wax dispersion medium can be adjusted mainly by adjusting the molecular weight of the vinyl-based polymer part. The molecular weight distribution can also be adjusted by the kind and amount of the wax used. The molecular weight of the vinyl-based polymer can be adjusted through the selection of a monomer used and control of reaction conditions.

The colorant in the magenta toner particles according to the present invention preferably comprises 70% by number of particles having particle sizes of 0.05 to 0.5 μm.

That is, heretofore, the average particle size was regarded as important when discussing a dispersion particle size of the colorant. Examinations carried out by the inventors of the present invention have found that dispersion particle size distribution of the colorant particles dispersed in the color toner particles is extremely important for improving the color reproduction. To be more specific, a broad dispersion particle size distribution unavoidably results in a large difference in a dispersion level of the colorant between the toner particles. In this case, even if the average particle size is reduced as much as possible, irregular light reflections is inevitably caused by relatively large colorant particles not sufficiently dispersed, leading to a tendency to make it impossible to obtain satisfactory color reproduction. In particular, a pale magenta toner, having as sharp dispersion particle size distribution as possible, is preferably used for reducing the roughness in the low-density region.

The colorant particles having very small particle sizes below 0.05 μm are basically perceived to not adversely affect reflection and absorption properties of light. Those particles contribute to satisfactory transparency on an OHP sheet, but coloring power degrades because of too small a dispersion particle size, thereby being responsible for degrading the chroma. On the other hand, if many colorant particles having particle sizes above 0.5 μm exist, the lightness and vividness of a projected image may inevitably degrade. Therefore, the colorant preferably comprises 70% or more by number, preferably 75% or more by number, and more preferably 80% or more by number of the colorant particles having particle sizes of 0.05 to 0.5 μm according to the present invention. The % by number of the colorant particles can be adjusted through classification, mixing of classified products, or the first kneading step (so-called masterbatch process).

In the present invention, magenta colorants, which can be used in pale magenta toner and deep magenta toner, include condensed azo compounds, diketo pyrrolo pyrrol compounds, anthraquinone, quinacridone compounds, base dye lake compounds, naphthol compounds, benzimidazolone compounds, thioindigo compounds, and perylene compounds. The magenta colorant is not always limited to these colorants. In particular, the colorants which can be preferably used include C.I. pigment red 2, 3, 5, 6, 7, 23, 31, 48:2, 48:3, 48:4, 57:1, 81:1, 122, 144, 146, 150, 166, 169, 177, 184, 185, 202, 206, 220, 221, 254, and C.I. pigment violet 19. Of those, a mixture of C.I. Pigment Red 122 and C.I. Pigment Red 57:1 is particularly preferable in terms of hue and coloring power.

Those colorants and the following yellow colorants, cyan colorants, or the like maybe mixed to prepare a magenta toner having preferable spectral distribution properties in a powder form.

The colorant is suitably selected in terms of hue angle, the chroma, the lightness, weatherability, the transparency on an OHP, and the dispersibility in the toner particles. The colorant in the pale magenta toner of the present invention is preferably added in 0.2 to 1.2 parts by mass with respect to 100 parts by mass of a binder resin. However, it is not necessary that the amount of the colorant added be in the above range. This is because the optimum addition amount for exerting the effect of the present invention varies depending on the type of the colorant used. That is, as in the present invention, measuring above spectral distribution properties of the magenta toner in a powder form and selecting the kind and amount of the colorant so that the above spectral values fall within the range of the present invention enable an image with satisfactory graininess and without roughness in the low-density region to be outputted.

In the case of the deep magenta toner, the colorant is preferably used in 2.0 to 8.0 parts by mass with respect to 100 parts by mass of the resin. If the amount of the colorant is below 2.0 parts by mass in the deep magenta toner, roles separate from the pale magenta toner become obscure. Therefore, the amount of the toner loaded becomes excessive when reproducing the high-density region, possibly invoking fixing failure. Further, if the amount exceeds 8.0 parts by mass, the dispersibility of the colorant becomes remarkably poor, possibly causing a problem such as inferior transparency of an image on an OHP sheet.

Various resins known as a binder resin for conventional electrophotography may be used for the binder resin of the present invention. Of those, a preferable binder resin is mainly composed of a resin selected from the group consisting of (a) a polyester resin, (b) a hybrid resin comprising a polyester unit and a vinyl-based copolymer unit, (c) a mixture of a hybrid resin and a vinyl-based copolymer, (d) a mixture of a hybrid resin and a polyester resin, (e) a mixture of a polyester resin and a vinyl-based copolymer, and (f) a mixture of a polyester resin, a hybrid resin comprising a polyester unit and a vinyl-based copolymer unit, and a vinyl-based copolymer.

When the polyester resin is used as the binder resin, a polyhydric alcohol and a polyvalent carboxylic anhydride, or a polyvalent carboxylic ester can be used as a material monomer.

Concretely, examples of a bivalent alcohol component include; alkylene oxide adducts of a bisphenol A such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, polytetramethylene glycol, bisphenol A, and hydrogenated bisphenol A.

Examples of a trivalent or more-valued alcohol component include sorbitol, 1,2,3,6-hexane tetrol, 1,4-sorbitan, pentaerythritol, dipentaerythritol, tripentaerythritol, 1,2,4-butanetriol, 1,2,5-pentanetriol, glycerol, 2-methylpropane triol, 2-methyl-1,2,4-butanetriol, tritethylol ethane, trimethylol propane, and 1,3,5-trihydroxymethyl benzene.

Examples of a polyvalent carboxylic acid component include: aromatic dicarboxylic acids such as a phthalic acid, isophthalic acid, and terephthalic acid or an anhydride thereof; alkyl dicarboxylic acids such as a succinic acid, adipic acid, sebacic acid, and azelaic acid or an anhydride thereof; a succinic acid which has a substituted alkyl group having 6 to 12 carbon atoms, or an anhydride thereof; unsaturated dicarboxylic acids such as a fumaric acid, maleic acid, and citraconic acid, or an anhydride thereof; n-dodecenyl succinic acid and isododecenyl succinic acid.

A polyester resin prepared by condensation polymerization of the following alcohol component and acid component is particularly preferable because of its satisfactory charging property as a color toner, as the alcohol component, a bisphenol derivative typified by the following formula (1)

(1)

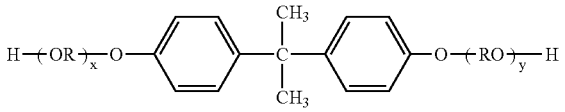

(In the formula, R denotes one or more chosen from an ethylene group and a propylene group, x and y each denote an integer of 1 or more, and an average value of x+y is 2 to 10.)

and, as the acid component, a carboxylic acid with a valence of 2 or more or an anhydride of the carboxylic acid, or a carboxylic acid component composed of a lower alkyl ester of the carboxylic acid (for example, fumaric acid, maleic acid, maleic anhydride, phthalic acid, and terephthalic acid).

It is preferable for forming a polyester resin having a crosslinking site to include a trivalent or more-valued carboxylic acid in the polyester resin. Examples of a trivalent or more-valued carboxylic acid component include 1,2,4-benzenetricarboxylic acid, 1,2,5-benzenetricarboxylic acid, 1,2,4-naphthalenetricarboxylic acid, 2,5,7-naphthalenetricarboxylic acid, 1,2,4,5-benzenetetracarboxylic acid, or anhydrides and ester compounds thereof.

The amount of the trivalent or more-valued carboxylic acid component to be used is preferably 0.1 to 1.9 mol % based on the amount of total monomers.

Moreover, in case of using a hybrid resin comprising a polyester unit, which is a polycondensation matter of a polyhydric alcohol and a polybasic having ester bonds in a main chain, and a vinyl-based polymer unit, which is a polymer having an unsaturated hydrocarbon base, as the binder resin, further improved wax dispersibility and enhanced low temperature fixability and offset resistance can be expected. The hybrid resin used in the present invention refers to a resin in which a vinyl-based polymer unit and a polyester unit are chemically bonded to each other. Specifically, a polyester unit and a vinyl-based polymer unit obtained by polymerizing a monomer having a carboxylate group such as a (meth)acrylate form the hybrid resin through an ester exchange reaction. Preferably, the polyester unit and the vinyl-based polymer form a graft copolymer (or a block copolymer) in which the vinyl-based polymer serves as a backbone polymer and the polyester unit serves as a branch polymer.

Examples of a vinyl-based monomer for producing the vinyl-based polymer or the vinyl-based polymer unit include: styrene; styrene derivatives such as o-methyl styrene, n-methyl styrene, p-methyl styrene, α-methyl styrene, p-phenyl styrene, p-ethyl styrene, 2,4-dimethyl styrene, p-n-butyl styrene, p-tert-butyl styrene, p-n-hexyl styrene, p-n-octyl styrene, p-n-nonyl styrene, p-n-decyl styrene, p-n-dodecyl styrene, p-methoxy styrene, p-chlorostyrene, 3,4-dichlorostyrene, m-nitrostyrene, o-nitrostyrene, and p-nitrostyrene; unsaturated mono-olefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; α-methylene aliphatic mono-carboxylic esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethyl amino ethyl methacrylate, and diethyl amino ethyl methacrylate; acrylic esters such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinyl pyrrole, N-vinyl carbazole, N-vinyl indole, and N-vinyl pyrrolidone; vinyl naphthalenes; and acrylic or methacrylic derivatives such as acrylonitrile, methacrylonitrile, and acrylamide.

Furthermore, there are included: unsaturated dibasic acids such as maleic acid, citraconic acid, itaconic acid, alkenyl succinic acid, fumaric acid, and mesaconic acid; anhydrides of unsaturated dibasic acids such as maleic anhydride, citraconic anhydride, itaconic anhydride, and alkenyl succinic anhydride; half esters of unsaturated dibasic acids such as maleic methyl half ester, maleic ethyl half ester, maleic butyl half ester, citraconic methyl half ester, citraconic ethyl half ester, citraconic butyl halt ester, itaconic methyl half ester, alkenyl succinic methyl half ester, fumaric methyl half ester, and mesaconic methyl half ester; esters of unsaturated dibasic acids such as dimethyl maleate and dimethyl fumarate; α,β-unsaturated acids such as acrylic acid, methacrylic acid, crotonic acid, and cinnamic acid; α,β-unsaturated acid anhydrides such as crotonic anhydride and cinnamic anhydride; anhydrides of α,β-unsaturated acids and lower fatty acid; and monomers including carboxylic group such as alkenyl malonic acid, alkenyl glutaric acid, and alkenyl adipic acid, anhydrides of these, and monoesters of these.

Furthermore, there are included: esters of acrylic acids or methacrylic acids such as 2-hydroxyethyl acrylate, 2-hydroxyethyl methacrylate, and 2-hydroxypropyl methacrylate; and monomers which has hydroxy groups such as 4-(1-hydroxy-1-methylbutyl)styrene and 4-(1-hydroxy-1-methylhexyl)styrene.

In the toner of the present invention, the vinyl-based polymer unit in the binder resin may also include a cross-linked structure cross-linked by a cross-linking agent including two or more vinyl groups. Examples of the cross-linking agent for use in this case include: an aromatic divinyl compound such as divinyl benzene and divinyl naphthalene; diacrylate compounds bonded by alkyl chains such as ethylene glycol diacrylate, 1,3-butylene glycol diacrylate, 1,4-butane diol diacrylate, 1,5-pentane diol diacrylate, 1,6-hexane diol diacrylate, neopentyl glycol diacrylate, and a compound whose acrylate replaced with methacrylate; diacrylate compounds bonded by alkyl chains including ether bond such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and a compound whose acrylate is replaced with methacrylate; diacrylate compounds bonded by chains including aromatic group and ether bond such as polyoxyethylene(2)-2,2-bis(4-hydroxyphenyl)propane diacrylate, polyoxyethylene(4)-2,2-bis(4-hydroxyphenyl)propane diacrylate, and a compound whose acrylate is replaced with methacrylate.

Examples of a multifunctional crosslinking agent include: pentaerythritol triacrylate, trimethylol ethane triacrylate, trimethylol propane triacrylate, tetramethylol methane tetraacrylate, oligo ester acrylate, and a compound whose acrylate is replaced with methacrylate; triallyl cyanurate; and triallyl trimellitate. Raw monomers producing the above polyester resins can be used as monomers producing polyester units constituting hybrid resins to be used in the present invention.

In the hybrid resin used in the present invention, it is preferable that one or both of a vinyl-based polymer unit component and a polyester resin unit comprise a monomer component that can react with both the resin components. Examples of a monomer that can react with a vinyl-based polymer unit out of monomers constituting a polyester resin component include: unsaturated dicarboxylic acids such as phthalic acid, maleic acid, citraconic acid, and itaconic acid; and anhydrides of these acids. Examples of a monomer that can react with a polyester resin component out of monomers constituting a vinyl-based polymer unit include: a monomer having a carboxyl group or a hydroxyl group; acrylic or methacrylic esters.

A preferable method of yielding a reaction product of a vinyl-based polymer unit and a polyester unit is as follows. A polymerization reaction to yield one or both of the vinyl-based polymer unit and the polyester unit is subjected in the presence of a polymer containing any of the monomer components that can react with each of the vinyl-based polymer and the polyester resin.

Examples of a polymerization initiator for use in manufacturing the vinyl-based polymer of the present invention include; 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutylate, 1,1'-azobis(1-cyclohexane carbonitrile), 2-(carbamoyl azo)-isobutyronitrile, 2,2'-azobis(2,4,4-trimethyl pentane), 2-phenyl azo-2,4-dimethyl-4-methoxyvaleronitrile, 2,2'-azobis(2-methyl-propane), ketone peroxides such as methyl ethyl ketone peroxide, acetyl acetone peroxide, and cyclohexanone peroxide, 2,2-bis(t-butyl peroxy)butane, t-butyl hydroperoxide, cumene hydroperoxide, 1,1,3,3-tetramethyl butyl hydroperoxide, di-t-butyl peroxide, t-butyl cumyl peroxide, di-cumyl peroxide, α,α'-bis(t-butyl peroxyisopropyl)benzene, isobutyl peroxide, octanoyl peroxide, decanoyl peroxide, lauroyl peroxide, 3,5,5-trimethyl hexanoyl peroxide, benzoyl peroxide, m-trioyl peroxide, di-isopropyl peroxydicarbonate, di-2-ethylhexyl peroxydicarbonate, di-n-propyl peroxydicarbonate, di-2-ethyoxy ethyl peroxycarbonate, di-methoxyisopropyl peroxydicarbonate, di(3-methyl-3-methoxybutyl)peroxycarbonate, acetylcyclohexyl sulfonyl peroxide, t-butyl peroxyacetate, t-butyl peroxyisobutylate, t-butyl peroxyneodecanoate, t-butyl peroxy-2-ethyl hexanoate, t-butyl peroxylaurate, t-butyl peroxybenzoate, t-butyl peroxyisopropyl carbonate, di-t-butyl peroxyisophthalate, t-butyl peroxyallyl carbonate, t-amyl peroxy-2-ethyl hexanoate, di-t-butyl peroxyhexahydroterephthalate, and di-t-butyl peroxyazelate.

Examples of a method for producing with which a hybrid resin can be prepared include methods for producing shown in the following items (1) to (5).

(1) The method comprises: producing a vinyl-based polymer and a polyester resin separately, dissolving and swelling them in a small amount of organic solvent, adding an esterification catalyst and alcohol to the mixture, and heating the whole to carry out an ester exchange reaction for synthesizing a hybrid resin.

(2) After a vinyl-based polymer is produced, a polyester resin and a hybrid resin component are produced in the presence of the vinyl-based polymer. The hybrid resin component is produced through a reaction between a vinyl-based polymer (a vinyl-based monomer may be added as required) and one or both of a polyester monomer (such as alcohol or a carboxylic acid) and the polyester. An organic solvent may be appropriately used in this case as well.

(3) After a polyester resin is produced, a vinyl-based polymer and a hybrid resin component are produced in the presence of the polyester resin. The hybrid resin component is produced through one or both of reactions between a polyester unit (a polyester monomer may be added as required) and a vinyl-based monomer.

(4) After a vinyl-based polymer unit and a polyester unit are produced, one or both of a vinyl-based monomer and a polyester monomer (such as alcohol or a carboxylic acid) is added in the presence of these polymer units to produce a hybrid resin component. An organic solvent may be appropriately used in this case as well.

(5) A vinyl-based monomer and a polyester monomer (such as alcohol or a carboxylic acid) are mixed, and the mixture is continuously subjected to an addition polymerization reaction and a condensation polymerization reaction to produce a vinyl-based polymer unit, a polyester unit, and a hybrid resin component. Furthermore, an organic solvent may be appropriately used.

Furthermore, after a hybrid resin component is produced by each of the methods for producing described in the items (1) to (4), a vinyl-based polymer and a polyester resin may be added to the component by adding one or both of a vinyl-based monomer and a polyester monomer (such as alcohol or a carboxylic acid) to carry out one or both of an addition polymerization reaction and a condensation polymerization reaction.

In each of the methods for producing described in the items (1) to (5), multiple polymer units different in molecular weight and in degree of crosslinking may be used for the vinyl-based polymer and the polyester unit.

The binder resin to be contained in the toner of the present invention may be a mixture of the polyester resin and the vinyl-based polymer, a mixture of the hybrid resin and the vinyl-based polymer, or a mixture of the polyester resin, the hybrid resin, and the vinyl-based polymer.

In the present invention, an available charge control agent to be comprised in the toner may be any of those known in the art. In particular, a metallic compound of an aromatic carboxylic acid is preferred because it has no color, has a high toner charge speed, and can maintain a constant charge amount stably Examples of a negative charge control agent include a metallic compound of salicylic acid, a metallic compound of naphthoic acid, a metallic compound of dicarboxylic acid, a high-molecular compound having sulfonic acid or carboxylic acid in the side chain, a boron compound, a urea compound, a silicon compound, and a calixarene. Examples of a positive charge control agent include a quaternary ammonium salt, a high-molecular compound having the quaternary ammonium salt in the side chain, a guanidine compound, and an imidazole compound. In particular, aluminium 3,5-di-tert-butylsalicylate is preferred because it exhibits rapid rise of charge amount. The charge control agent may be included (internally added) in the toner particles or may be mixed (externally added) with the toner particles. The amount of the charge control agent to be added is preferably 0.5 to 10 parts by mass with respect to 100 parts by mass of a binder resin. A known fluidity improving agent can be externally added to the magenta toner particles of the present invention. In particular, external addition of the fluidity improving agent is preferable from the viewpoints of image quality improvement and shelf life under a high temperature environment. Examples of preferable fluidity improving agents include inorganic fine powder such as silica, titanium oxide, aluminum oxide. Of those, silica is particularly preferable. The inorganic fine powder is preferably subjected to hydrophobic treatment using a hydrophobic agent such as a silane compound, silicone oil, or a mixture thereof.

Examples of the hydrophobic agent include: coupling agents such as a silane compound, a titanate coupling agent, an aluminium coupling agent, and a zircoaluminate coupling agent; and a silicone oil.

Concretely, a compound represented by a general formula (2) is preferable as the silane compound. Examples of the silane compound include hexamethyldisilazane, vinyltrimethoxysilane, vinyltriethoxysilane, γ-methacryloxypropyltrimethoxysilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane, and n-octadecyltrimethoxysilane. The amount for treating the inorganic fine powder is preferably 1 to 60 parts by mass, more preferably 3 to 50 parts by mass based on 100 parts by mass of the inorganic fine powder.

$$R_mSiY_n \quad (2)$$

(In the formula, R represents an alkoxy group, m represents an integer of 1 to 3, Y represents a functional group selected from the group consisting of an alkyl group, a vinyl group, a phenyl group, a methacryl group, an amino group, an epoxy group, a mercapto group, and derivatives thereof, and n represents an integer of 1 to 3 provided that m+n=4.).

Alkylalkoxysilane represented by the following general formula (3) is particularly preferable for the hydrophobic treatment of the surface of the fluidity improving agent in the present invention.

$$C_nH_{2n+1}—Si—(OC_mH_{2m+1})_3 \quad (3)$$

(In the formula, n represents an integer of 4 to 12, and m represents an integer of 1 to 3.)

The alkylalkoxysilane represented the above-mentioned general formula (3) with n smaller than 4 is not preferable because it facilitates the hydrophobic treatment but provides low hydrophobicity. If n is larger than 12, titanium oxide fine particles may greatly coalesce to result in low fluidity imparting ability, although sufficient hydrophobicity can be obtained. If m is larger than 3, the alkylalkoxysilane may become less reactive, inhibiting a satisfactory hydrophobic treatment. For the alkylalkoxysilane, n is preferably 4 to 8, and m is preferably 1 or 2. An amount of the alkylalkoxysilane used for the treatment is preferably 1 to 60 parts by mass, more preferably 3 to 50 parts by mass with respect to 100 parts by mass of the inorganic fine powder.

The hydrophobic treatment of the fluidity improving agent may be performed using one kind of the hydrophobic agent, or using two or more kinds of the agents in combination. For example, the hydrophobic treatment may be performed using one kind of the hydrophobic agent alone, using two kinds of the hydrophobic agents simultaneously, or first using one kind of the hydrophobic agent for the hydrophobic treatment and then using another hydrophobic agent for further treatment.

The fluidity improving agent is added in an amount of preferably 0.01 to 5 parts by mass, and more preferably 0.05 to 3 parts by mass with respect to 100 parts by mass of the toner particles.

Examples of the colorant used in the other color toner to be used in the magenta toner of the present invention include the following.

Examples of a black colorant include carbon black, a magnetic material, magnetite, and a material in which the color thereof is adjusted to black with the following yellow, magenta, and cyan colorants. However, the colorant is not always limited to them.

Examples of the yellow colorant include a condensation azo compound, an isoindolinone compound, an anthraquinone compound, an azo metal complex, a methine compound, and an allylamide compound. Specifically, preferred examples of the yellow colorant include C.I. Pigment Yellow 12, 13, 14, 15, 17, 62, 74, 83, 93, 94, 95, 97, 109, 110, 111, 120, 127, 128, 129, 147, 155, 168, 174, 176, 180, 181, and 191. Of those, C.I. Pigment Yellow 74 is most suitable as the yellow colorant to be used in combination with the magenta toner of the present invention. This is because the reproducibility of a red color obtained as a mixed color with the magenta toner of the present invention, and therefore the chroma of red-based colors become maximum.

Examples of the cyan colorant include copper phthalocyanine compounds and derivatives thereof, anthraquinone compounds, and base dye lake compounds. However, the cyan colorant is not always limited to them In particular, preferable specific colorants include C.I. pigment blue 1, 7, 15, 15:1, 15.2, 15:3, 15:4, 60, 62, and 66. They can be also used alone. Of those, C.I. Pigment Blue 15:3 is particularly desirably used as a base in combination with a green-based colorant.

The magenta toner of the present invention preferably comprises a magnetic material when the magenta toner is used as a magnetic toner. Examples of the magnetic material used in the present invention include a metallic oxide containing an element such as iron, cobalt, nickel, copper, magnesium, manganese, aluminum, or silicon. Among them, a magnetic material mainly containing an iron oxide such as black iron oxide or γ-iron oxide is preferable. The magnetic material may contain a metallic element such as a silicon element or an aluminum element from the standpoint of controlling changeability of the toner. Particles of such magnetic materials have a BET specific surface area by nitrogen adsorption of preferably 2 to 30 $m^2/g$, particularly preferably 3 to 28 $m^2/g$, and have a Mohs' hardness of preferably 5 to 7.

Examples of the shape of the magnetic material include an octahedral shape, a hexahedral shape, a spherical shape, a needle shape, and a scaly shape. The magnetic material preferably has a shape with a low degree of anisotropy such as the octahedral shape, the hexahedral shape, or the spherical shape in order to increase an image density. The average particle size of the magnetic material is preferably 0.05 to 1.0 μm, more preferably 0.1 to 0.6 μm, and still more preferably 0.1 to 0.4 μm.

The content of the magnetic material is 30 to 200 parts by mass, preferably 40 to 200 parts by mass, and more preferably 50 to 150 parts by mass with respect to 100 parts by mass of the binder resin. If the content is less than 30 parts by mass, in a developing unit utilizing a magnetic force for carrying a toner, the toner carrying ability of the unit decreases. Thus, unevenness tends to occur in a developer layer on a toner carrier to result in image unevenness. Moreover, a decrease in the image density tends to easily occur owing to an increase in the triboelectrification of a magnetic toner. On the other hand, if the content exceeds 200 parts by mass, a problem tends to arise in terms of fixability.

The color toner includes the magenta toner of the present invention can be used for nonmagnetic one-component development. Furthermore, in the case where the toner of the present invention is used for a two-component developer, the toner is mixed with a magnetic carrier before use.

Known magnetic carriers such as a magnetic particle itself, a coated carrier obtained by coating a magnetic particle with a resin, and a magnetic material dispersed resin carrier obtained by dispersing a magnetic particle in a resin particle can be used as the magnetic carrier. Examples of the magnetic particle include: metallic particles such as surface-oxidized or -unoxidized iron, lithium, calcium, magnesium, nickel, copper, zinc, cobalt, manganese, chromium, and rare earths; alloy particles and oxide particles thereof; and ferrites.

The above coated carrier obtained by coating the surface of a magnetic carrier particle with a resin is particularly preferable for use in a developing method in which an AC bias is applied to a developing sleeve. Examples of an applicable coating method include conventionally known methods such as: a method in which a coating liquid prepared by dissolving or suspending a coating material such as a resin in a solvent is allowed to adhere to the surface of a magnetic carrier core particle; and a method in which a magnetic carrier core particle and a coating material are mixed in powder form.

Examples of the coating material for the surface of the magnetic carrier core particle include a silicone resin, a polyester resin, a styrene-based resin, an acrylic resin, polyamide, polyvinyl butyral, and an aminoacrylate resin. One or plural of those resins are used. The coating amount of the above coating material is preferably 0.1 to 30% by mass (more preferably 0.5 to 20% by mass) with respect to the carrier core particle. Those magnetic carrier core particles have an average particle size of preferably 10 to 100 μm, more preferably 20 to 70 μm.

In the case where the toner of the present invention and a magnetic carrier are mixed to prepare a two-component developer, a mixing ratio is 2 to 15% by mass, preferably 4 to 13% by mass as a toner concentration in the developer. The toner concentration within such a range ordinarily provides a satisfactory result. A toner concentration of less than 2% tends to reduce the image density. A toner concentration in excess of 15% tends to cause fogging or scattering in a machine.

In the present invention, as an average circularity of particles each having a circle-equivalent diameter of 2 μm or more in the toner, a desirable shape of the magenta toner represents in the range of 0.920 to 0.945, preferably in the range of 0.922 to 0.943.

If the average circularity is less than 0.920, transferability, especially transferring efficiency, is poor, graininess in the low-density region increases, and as a result, an image with high roughness may be obtained. Contrarily, if the average circularity is greater than 0.945, in cleaning of a photosensitive drum, the shapes of the particles are so close to spherical shapes that, for example, the particles may pass through a cleaning blade, causing detrimental effects on the obtained image due to faulty cleaning. The average circularity of the magenta toner of the present invention can be adjusted by using a surface modifying device to be described later.

Next, procedures for manufacturing a toner are described. A toner of the present invention can be manufactured by melting and kneading a binder resin, a colorant, a wax, and an arbitrary material, cooling and pulverizing the kneaded product, classifying the pulverized products as required, and mixing the pulverized products and the flowability improving agent as required.

First, in a raw material mixing step, predetermined amounts of at least resin and a colorant, as toner internal additives, are weighted, and then compounded and mixed together. Examples of a mixing device include a double con mixer, a V-type mixer, a drum-type mixer, a Super mixer, a Henschel mixer, and a nauta mixer.

Further, the toner raw materials mixed as described above are melted and kneaded to melt resins, and the colorant and the like are dispersed in the melted resin. In the melting and kneading step, for example, a batch kneader such as a pressure kneader, a Banbury mixer, etc. or a continuous kneader can be used. Recently, due to the advantage of allowing continuous production, a single-screw or twin-screw extruder is becoming mainstream. For example, a KTK series twin-screw extruder from KOBE STEEL, LTD., a TEM series twin-screw extruder from TOSHIBA MACHINE CO., LTD., a twin-screw extruder from KCK Corporation, a co-kneader from Buss Co., Ltd, and the like are generally used. A colored resin composition obtained by melting and kneading the toner raw materials is rolled out by two rolls or the like after the melting and kneading step, and then cooled through a cooling step of cooling the composition by water cooling or the like.

Subsequently, the resulting cooled product of the colored resin composition obtained as described above is usually pulverized into a predetermined particle size by a pulverizing step. In the pulverizing step, first, the colored resin composition is roughly pulverized with a crusher, a hammer mill, a feather mill, or the like, followed by further pulverizing with a Criptron system from Kawasaki Heavy Industries, Ltd., a Super Rotor from Nisshin Engineering, or the like. Subsequently, the pulverized products are classified by using a screen classifier, for example, a classifier such as an Elbow-Jet classifier (from NITTESU MINING CO., LTD) employing an inertia classification system, a Turboplex classifier (from HOSOKAWA MICRON CORPORATION) employing a centrifugal classification system, etc., to obtain toner particles having weight-average particle sizes in the range of 3 to 11 μm.

As required, surface modification and rounding are performed in the surface modification step by using, for example, a hybritization system from NARA MACHINERY CO., LTD, or a mechanofusion system from HOSOKAWA MICRON CORPORATION.

In the present invention, it is preferable that no mechanical pulverizing be performed in the pulverizing step, and that a device that performs classification and surface modification treatment using a mechanical impact force be used after pulverizing with an air jet type pulverizing machine to thereby obtain toner particles having weight-average particle sizes in the range of 3 to 11 μm. The surface modification treatment and the classification may be performed separately, in which case a screen classifier such as HIBOLTA (from Shin Tokyo Kikai Corporation) that is a wind screen may be used. In addition, examples of a method of externally adding external additives include compounding predetermined amounts of the classified toner and known various external additives and then stirring and mixing them by using as an external adding machine a high-speed stirrer that applies a shearing force to powder, such as a Henschel mixer, a Super mixer, or the like.

Figure 4:
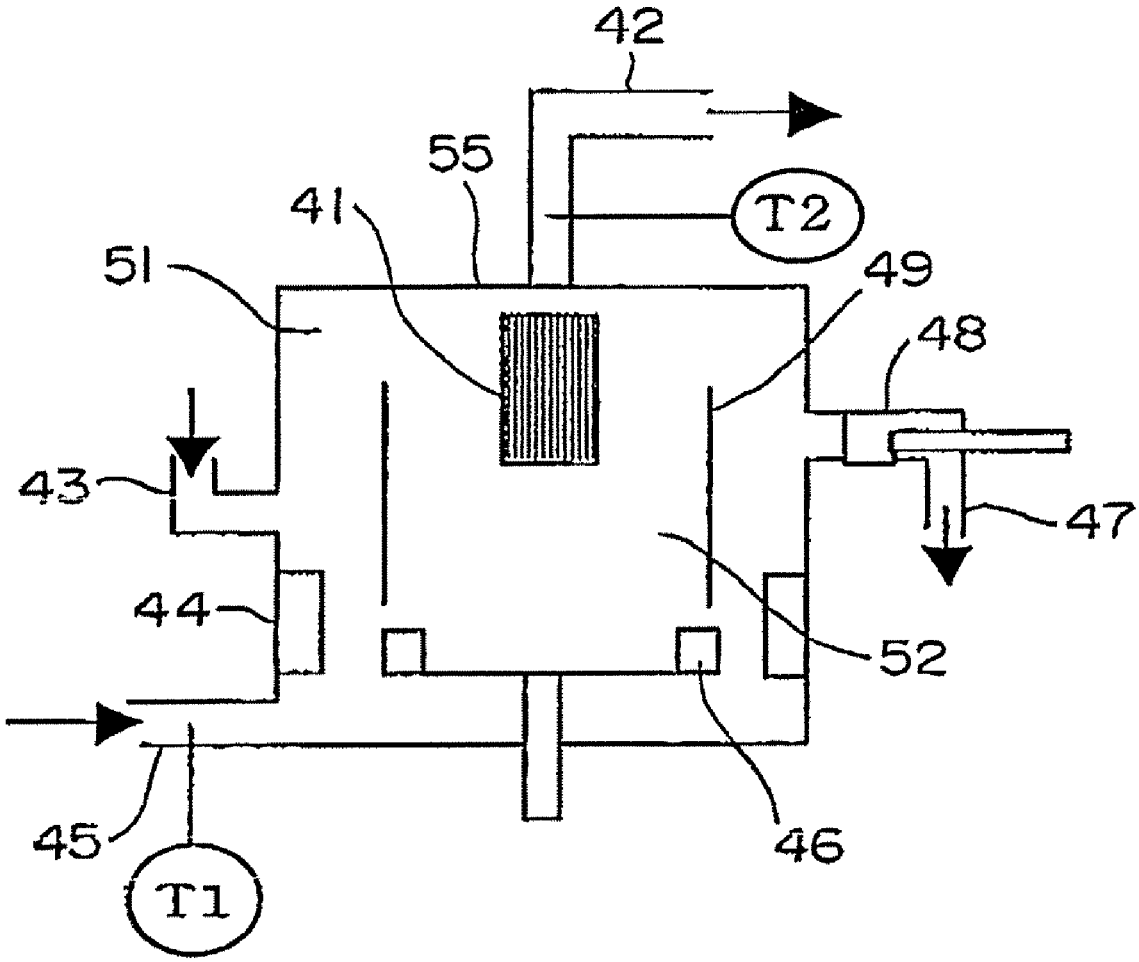
FIG. 4 is a schematic diagram showing a structure of an example of a surface modification device suitably used for producing the magenta toner of the present invention.

FIG. 4 shows an example of a surface modifying device used in the present invention. The surface modifying device shown in FIG. 4 comprises: a casing 55; a jacket (not shown) through which cooling water and an antifreezing fluid can pass; a classifying rotor 41 as classifying means for classifying between particles having sizes larger than a predetermined particle size and fine particles having the predetermined particle size and less; a dispersing rotor 46 as surface treatment means for treating the surface of the above-mentioned particles by applying a mechanical impact to the particles; a liner 44 arranged circumferentially on an outer periphery of the dispersing rotor 46 at a predetermined interval; a guide ring 49 as guiding means for guiding, from among the particles classified by the classifying rotor 41, the particles having sizes larger than the predetermined size to the dispersing rotor 46; a discharge port for collecting fine powders 42 as discharging means for discharging, from among the particles classified by the classifying rotor 41, the fine particles having the predetermined particle size and less to the outside; a cold air introduction port 45 as particle circulation means for sending the particles having their surfaces treated by the dispersing rotor 46 to the classifying rotor 41; a raw material supply port 43 for introducing particles to be treated into the casing 55; and a powder discharge port 47 and a discharge valve 48, which are openable and closable, for discharging the surface-treated particles from the casing 55.

The classifying rotor 41 is a cylindrical rotor and is provided on one end surface side inside the casing 55. The fine powder collection discharge port 42 is provided on one end portion of the casing 55 so that particles present inside the classification rotor 41 are discharged therefrom. The raw material supply port 43 is provided in a central portion of a circumferential surface of the casing 55. The cold air introduction port 45 is provided on the other end surface side on the circumferential surface of the casing 55. The powder discharge port 47 is provided on the circumferential surface of the casing 55 at a position opposite to the raw material supply port 43. The discharge valve 48 is a valve capable of freely opening and closing the powder discharge port 47.

Figure 5:
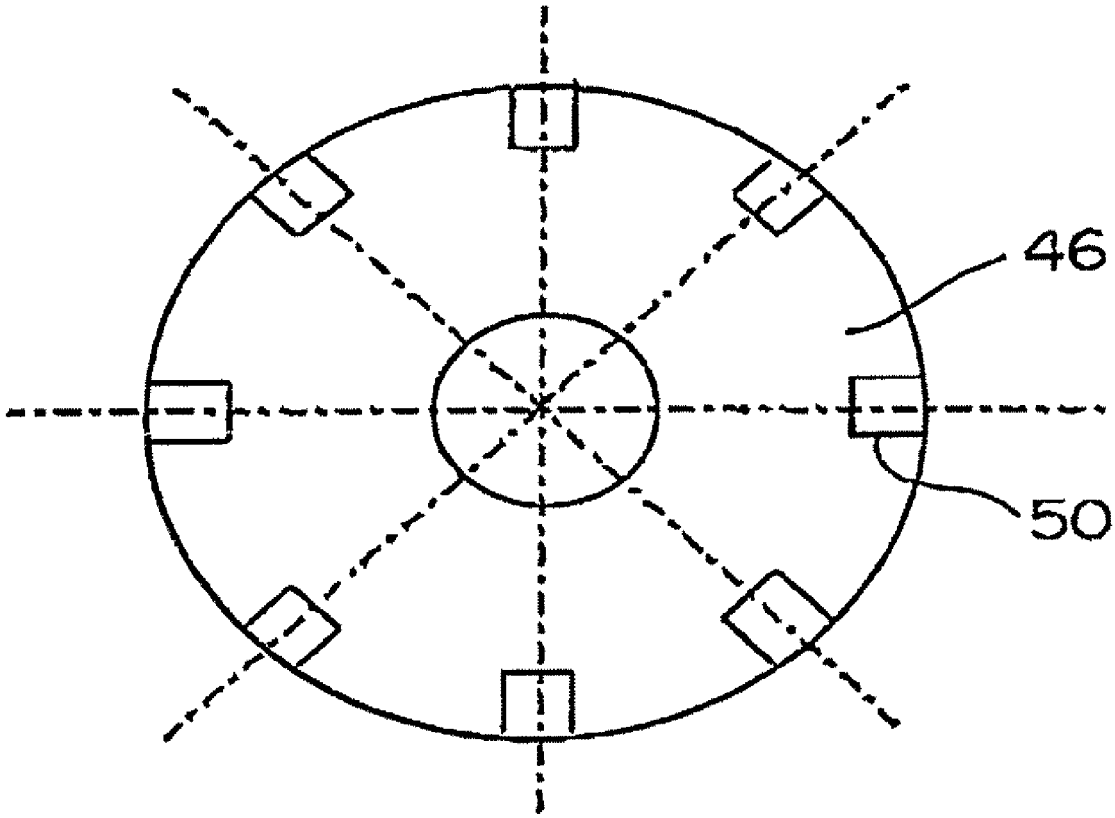
FIG. 5 is a diagram showing a dispersion rotor shown in FIG. 4 and an arrangement of square discs provided thereon.

The dispersing rotor 46 and the liner 44 are provided at a position which is upper than the cold air introduction port 45 and lower than the raw material supply port 43 and the powder discharge port 47. The liner 44 is arranged circumferentially along an inner peripheral surface of the casing 55. As shown in FIG. 5, the dispersing rotor 46 comprises a circular disk and plural square disks 50 arranged on normal of the circular disk along the outer edge of the circular disk. The dispersion rotor 46 is provided on the other end surface side of the casing 55 and arranged such that a predetermined gap is formed between the liner 44 and each square disk 50. The guide ring 49 is provided in the central portion of the casing 55. The guide ring 49 is a cylindrical member provided so as to extend from a position where it covers a part of the outer peripheral surface of the classifying rotor 41 to the vicinity of the classifying rotor 41. By means of the guide ring 49, the interior of the casing 55 is divided into a first space 51 sandwiched between the outer peripheral surface of the guide ring 49 and the inner peripheral surface of the casing 55, and a second space 52 defined inside the guide ring 49.

Note that the dispersing rotor 46 may have cylindrical pins instead of the square disks 50. While in this embodiment the liner 44 has a large number of grooves provided on its surface opposing the square disk 50, the liner 44 may not have such grooves on its surface. Also, the classifying rotor 41 may be installed either vertically as shown in FIG. 4 or horizontally. In addition, one classifying rotor 41 may be provided as shown in FIG. 4, or two or more classifying rotors 41 may be provided.

In the surface modifying device constructed as described above, when a finely pulverized product is introduced from the raw material supply port 43 with the discharged valve 48 being in the "closed" state, first, the introduced a finely pulverized product is sucked in by a blower (not shown) and then subjected to classification by the classifying rotor 41. At this time, fine powders classified as having particle sizes equal to a predetermined particle size or smaller pass through the circumferential surface of the classifying rotor 41 to be introduced into the inside of the classifying rotor 41, and then continuously discharged and removed from the device to the exterior. Coarse powders having particle sizes larger than the predetermined particle size are carried on a circulation flow generated by the dispersion rotor 46 while moving along an inner periphery (second space 52) of the guide ring 49 due to a centrifugal force, to be introduced to the gap (hereinafter also referred to as the "surface modification zone") between the square disk 50 and the liner 44. The powders introduced into the surface modification zone are subjected to surface modification by receiving a mechanical impact force between the dispersing rotor 46 and the liner 44. The surface-modified particles are carried on cold air passing through inside the machine, to be transported along the outer periphery (first space 51) of the guide ring 49 to reach the classifying rotor 41. By the classifying rotor 41, the fine powers are discharged to the outside of the machine whereas the coarse powders are returned again to the second space 52 where the surface modifying operation is repeated therefore. In this way, with the surface modifying device of FIG. 4, the classification of particles using the classifying rotor 41 and the surface treatment of the particles using the dispersing rotor 46 are repeated. Then, after a given period of time has elapsed, the discharge valve 48 is opened to collect the surface-modified particles from the discharge port 47.

Upon examination, the inventors of the present invention have found that a period of time until the opening of the discharge valve (cycle time) and the rotating rate of the dispersing rotor are important in controlling an average circularity of the magenta toner and an amount of wax present on the magenta toner surface. To increase the average circularity, it is effective to make the cycle time longer or increase a rotating rate of the dispersing rotor. Further, to restrain the amount of the releasing agent on the toner surface, conversely, it is effective to make the cycle time shorter or to lower the rotating rate. Thus, from the viewpoint of appropriately adjusting the average circularity of the magenta toner and the amount of wax present on the toner surface, it is preferable that the above-mentioned rotating rate is not lower than $1.2\times10^5$ mm/sec and the above-mentioned cycle time is within a range of 5 to 60 seconds.

Hereinafter, a method for forming an image of the present invention using the magenta toner of the present invention will be described.

According to the present invention, there is provided a method for forming an image, comprising: forming a first electrostatic charge image on an electrostatic charge image bearing member; forming a first magenta toner image by developing the first electrostatic charge image with a first magenta toner; transferring the first magenta toner image to a transfer material through an intermediate transfer member or directly; forming a second electrostatic charge image on the electrostatic charge image bearing member; forming a second magenta toner image by developing the second electrostatic charge image using a second magenta toner; transferring the second magenta toner image to the transfer material through the intermediate transfer member or directly; and fixing the first magenta toner image and the second magenta toner image on the transfer material under heating and pressure to form a fixed image on the transfer material, in which the first magenta toner is one of a pale magenta toner and a deep magenta toner, and the second magenta toner is the other of the pale magenta toner and the deep magenta toner. In addition, the above-described magenta toner is used as the pale magenta toner.

A method for forming an image of the present invention is also preferably a method for forming a full-color image comprising: using the toner of the present invention described above as a pale magenta toner and a deep magenta toner having a lightness smaller than that of the pale magenta toner, a cyan toner, a yellow toner, and a black toner; forming electrostatic charge images corresponding to toner images of respective colors on an electrostatic charge image bearing member; developing the electrostatic charge images of the respective colors using the corresponding toners, sequentially transferring the toner images of the respective colors obtained through the development to a transfer material in a superimposed manner; and fixing the toner images of the respective colors superimposed on the transfer material under heating and pressure to form a full-color image.

The electrostatic charge image bearing member used in a method of forming an image for forming an image by using the magenta toner of the present invention may have a contact angle of 85° or more (preferably, 90° or more) with respect to water on the surface of the electrostatic charge image bearing member. When the contact angle with respect to water is more than 85°, the transfer rate of the toner image is increased. In this case, the filming of the toner hardly occurs.

The method for forming an image of the present invention is particularly effective when the surface of the electrostatic charge image bearing member is mainly constituted of a high molecular binder. Examples of the cases where the method for forming an image of the present invention is particularly effective include: a case of providing a protective film of mainly a resin on an inorganic photosensitive layer made of selenium, amorphous silicon, or the like; a case where a surface layer consisting of a charge transport material and the resin is provided as a charge transport layer of a separated-function type organic photosensitive layer; and a case of providing a protective layer such as the protective film thereon.

Examples of a method of imparting releasability to the surface layer include (1) using a resin with low surface energy for the resin itself constituting the layer, (2) adding an additive imparting water repellency or lipophilic property, and (3) dispersing in a powder form a material having high releasability.

Introduction of a fluorine-containing group and a silicon-containing group to a structure of the resin may achieve the method (1). An additive such as a surfactant may be used for the method (2). Powder of a fluorine compound such as polyethylene tetrafluoride, polyvinylidene fluoride, or carbon fluoride may be used for the method (3), and polyethylene tetrafluoride is particularly preferable of those. In the present invention, dispersion of releasable powder such as a fluorine-containing resin of the method (3) in the outermost surface layer is particularly preferable.

To incorporate such powder into the surface, a layer obtained by dispersing the powder in a binder resin may be provided on the outermost surface of the electrostatic charge image bearing member. Alternatively, if the organic photosensitive layer is composed mainly of a resin, the powder may be dispersed in the uppermost layer without providing a new surface layer.

An amount of the powder added to the surface layer is preferably 1 to 60% by mass, and more preferably 2 to 50% by mass with respect to the total mass of the surface layer. If the amount is below 1% by mass, an improving effect is small. If the amount is above 60% by mass, film strength may decrease or amount of incident light to the electrostatic charge image bearing member may decrease undesirably.

The present invention is particularly effective for a direct charging method in which the charging means makes contact a charging member with the electrostatic charge image bearing member. The direct charging method poses a heavy load against the surface of the electrostatic latent image bearing member compared to corona discharge in which the charging means is not in contact with the electrostatic charge image bearing member. Therefore, an improving effect is remarkable in terms of lifetime of the electrostatic charge image bearing member.

Hereinafter, a preferable mode of the electrostatic charge image bearing member used in the present invention will be described. The electrostatic charge image bearing member is generally structured with a conductive substrate and various layers formed on the surface of the conductive substrate.

Examples of the material of the conductive substrate include: metals such as aluminum and stainless steel; plastic materials having coat layers made of alloys such as aluminum alloy and indium oxide-tin oxide alloy; paper and plastic with which conductive particles are dispersed; and plastic having conductive polymers, for example. Examples of the substrate include a cylindrical tube and a film.

A base layer may be formed on the conductive substrate for improving the adhesion of the photosensitive layer, improving a coating ability, protecting the substrate, covering the defects on the substrate, improving the charge injection from the substrate, protecting the photosensitive layer from electrical destruction. The base layer is formed of a material such as polyvinyl alcohol, poly-N-vinyl imidazole, polyethylene oxide, ethyl cellulose, methyl cellulose, nitrocellulose, ethylene-acrylic copolymer, polyvinyl butyral, phenolic resin, casein, polyamide, copolymerized nylon, glue, gelatin, polyurethane, or aluminum oxide. The thickness of the base layer is typically in the range of 0.1 to 10 μm, preferably 0.1 to 3 μm.

The charge generation layer maybe formed on the base layer. The charge generation layer is prepared by dispersing a charge generation material into an appropriate binder and coating or depositing the material on the substrate. The charge generation material may be selected from organic materials including azo pigments, phthalocyanine pigments, indigo pigments, perylene pigments, polycyclic quinone pigments, squalelium pigments, pyrylium salts, thiopyrylium salts, and triphenyl methane pigments; and inorganic materials such as selenium and amorphous silicon.

The binder can be selected from various kinds of resins having a binding ability. For instance, such resins include polycarbonate resin, polyester resin, polyvinyl butyral resin, polystyrene resin, acrylic resin, methacrylic resin, phenolic resin, silicone resin, epoxy resin, and vinyl acetate resin. The amount of the binder contained in the charge generation layer is 80% by mass or less, preferably 0 to 40% by mass. The charge generation layer preferably has a film thickness of 5 μm or less, particularly in the range of 0.05 to 2 μm.

The charge transport layer may be formed on the charge generation layer in the electrostatic charge image bearing member. The charge transport layer has functions of receiving charge carriers from the charge generation layer in the presence of an electric field and transporting the charge carriers. The charge transport layer is formed by dissolving a charge transport material and optionally a binder resin as needed in a solvent and coating the entire substrate. The film thickness of the charge transport layer is typically in the range of 5 to 40 μm. Examples of the charge transport materials include: polycyclic aromatic compounds each having structures such as biphenylene, anthracene, pyrene, and phenanthrene on its main chain or side chain; nitrogen-containing cyclic compounds such as indole, carbazole, oxadiazole, and pyrazoline; hydrazone compounds; styryl compounds; and inorganic compounds such as selenium, selenium-tellurium, amorphous silicon, and cadmium sulfide.

The binder resins into which these charge transport materials can be dispersed include: resins such as polycarbonate resin, polyester resin, polymethacrylate, polystyrene resin, acrylic resin, and polyamide resin; and organic photoconductive polymers such as poly-N-vinyl carbazole and polyvinyl anthracene.

Furthermore, a protective layer may be formed as a surface layer. Resins to be used as a protective layer include polyester, polycarbonate, acrylic resin, epoxy resin, phenolic resin, or cured products obtained by curing these resins with a curing agent. Each of these compounds may be used independently, or two or more of the resins may be used in combination.

Conductive fine particles may be dispersed in the resin of the protective layer. The examples of the conductive fine particles include fine particles of metals or metal oxides. Preferably, the conductive fine particles include zinc oxide, titanium oxide, tin oxide, antimony oxide, indium oxide, bismuth oxide, titanium oxide coated with tin oxide, indium oxide coated with tin, tin oxide coated with antimony, and zirconium oxide. Each of these compounds may be used independently, or two or more of the compounds may be used in combination. Typically, for preventing the scattering of incident light by conductive fine particles in the case of dispersing conductive fine particles into the protective layer, it is preferable that the particle diameter of each of conductive fine particles is smaller than the wavelength of the incident light. The particle diameter of each of conductive fine particles to be dispersed in the protective layer is preferably 0.5 μm or less. The content of conductive fine particles in the protective layer is preferably in the range of 2 to 90% by mass, more preferably in the range of 5 to 80% by mass with respect to the total mass of the protective layer. The film thickness of the protective layer is preferably in the range of 0.1 to 10 μm, more preferably 1 to 7 μm.

The coating of the surface layer can be performed by spray coating, bean coating, or dip coating with a liquid in which resins are dispersed.

In the case of using the magenta toner of the present invention in a one-component developing method, for attaining a high image quality, it is preferable that the toner be developed by the developing step in which the toner with a layer thickness smaller than the most contiguous distance (between S and D) of toner carrier-electrostatic charge image bearing member is coated on the toner carrier, followed by applying an alternating electric field thereon, thereby performing development.

The surface roughness of the toner carrier to be used in the present invention is preferably in the range of 0.2 to 3.5 μm in terms of the JIS center line average height (Ra). When the Ra is less than 0.2 μm, the amount of charges on the toner carrier tends to be increased. Therefore, the developing performance can be easily deteriorated. When the Ra exceeds 3.5 μm, unevenness tends to be caused on the toner coat layer of the toner carrier. The above surface roughness is more preferably in the range of 0.5 to 3.0 μm.

Furthermore, it is preferable to control the total charging amount of toner at the time of developing because the magenta toner of the present invention has a high charging ability. From this point of view, the surface of the toner carrier is preferably coated with a resin layer in which conductive fine particles and a lubricant are dispersed.

As the conductive fine particles to be contained in the resin layer that covers the surface of the toner carrier, carbon black, graphite, or a conductive metal oxide or a double metal oxide such as conductive zinc oxide is used. These oxides are used independently, or two or more of the oxides are used in combination. The resins in which the conductive fine particles can be dispersed include phenolic resin, epoxy resin, polyamide resin, polyester resin, polycarbonate resin, polyolefin resin, silicone resin, fluororesin, styrene resin, and acrylic resin. In particular, thermosetting or photo curing resins are preferable.

In forming an image using the magenta toner of the present invention, a member restricting the toner on the toner carrier is preferably provided in contact with the toner carrier through the toner for uniformly charging the toner. The member is particularly preferably an elastic member. According to the present invention, a charge member and a transfer member are preferably in contact with the electrostatic charge image bearing member to prevent ozone generation for reducing image deletion phenomenon.

Figure 6:
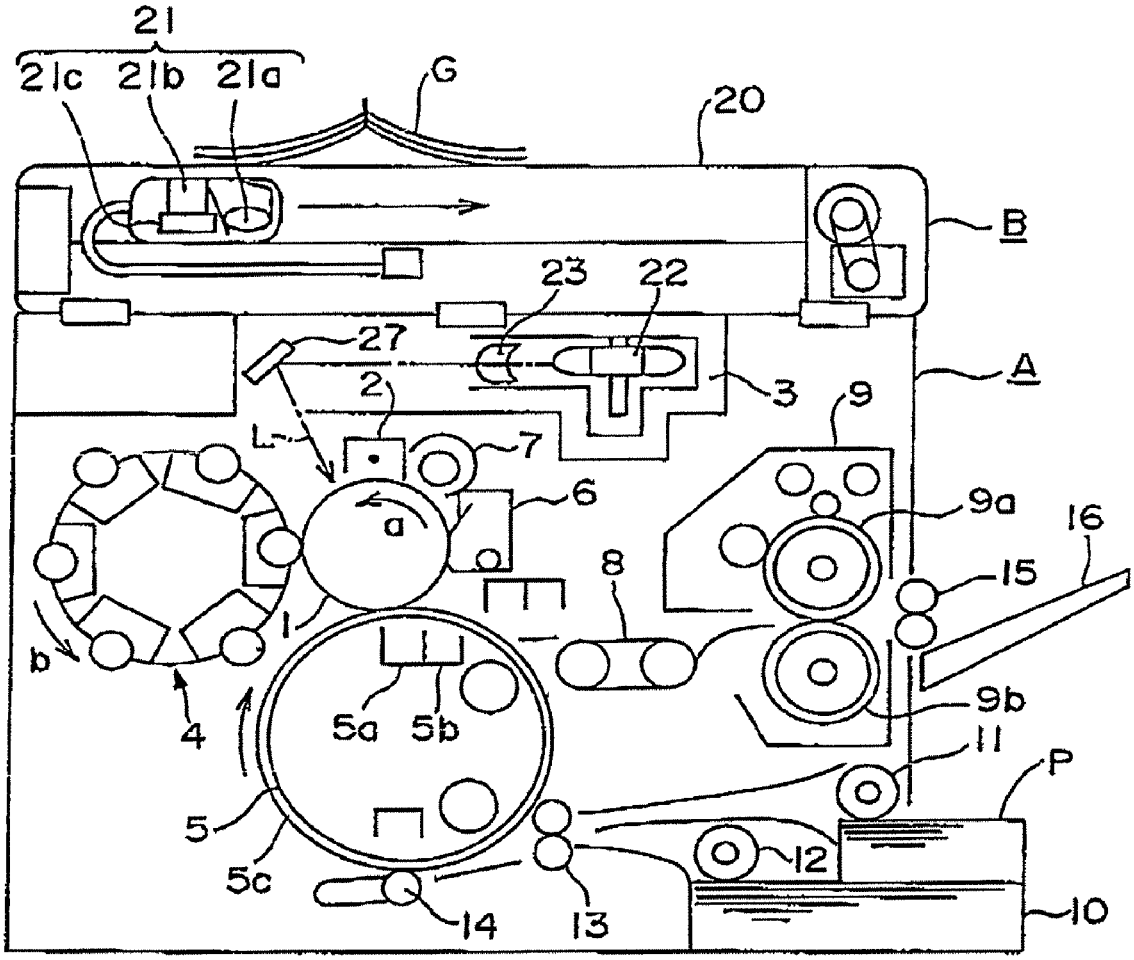
FIG. 6 is a schematic diagram showing a structure of an example of an image forming apparatus used in full-color image formation employing the magenta toner of the present invention.

Referring now to FIG. 6, the method for forming an image of the present invention is described in a more concrete manner. In FIG. 6, reference symbol "A" denotes a printer part and "B" denotes an image reader part (an image scanner) mounted on the printer part A. The method for forming an image using the magenta toner of the present invention can be performed by appropriately using conventionally known means and devices relating to image formation. In the method for forming an image using the magenta toner of the present invention, an electrostatic latent image forming means (exposure device described later, for example) is used because two or more kinds of the toners are generally used. The electrostatic latent image forming means can form an electrostatic latent image according to the deep and pale of the color of the toner or kind of the toner.

In the image reader part B, reference numeral 20 denotes a copy base plate glass being fixed in place. A copy G can be placed on the top of the copy base plate glass 20 such that the surface of the copy to be copied is placed face down, followed by placing a copy plate (not shown) thereon. The reference numeral 21 denotes an image reader unit that includes a lamp 21*a* for irradiating the copy, a short-focus lens array 21*b*, and a CCD sensor 21*c* which is as a fullcolor sensor.

Under the copy base plate glass 20 in the FIG. 6, the image reader unit 21 is able to move forward from a home position on the left side, to the page space of FIG. 6, of the copy base plate glass 20 to the right side thereof along the bottom surface of the glass when a copy button (not shown) is pushed down. After reaching to the predetermined terminal point of the reciprocating movement, the image reader unit 21 moves backward to return to the initial home position.

During the reciprocating movement of the image reader unit 21, the image surface of the copy G facing downward placed on the copy base plate glass 20 is sequentially illuminated and scanned from the left side to the right side with light irradiated from the lamp 21*a* for irradiating the copy. The illuminating and scanning light incident on the image surface of the copy is reflected from the image surface. Subsequently, the reflected light is incident on the CCD sensor 21*c* by passing through the short-focus lens array 21*b* to form an image.

The CCD sensor 21*c* is composed of a light receiving portion, a light transmitter, and an output device (not shown). The light receiving portion converts light signals into charge signals, followed by transmitting the charge signals into the output device in sync with clock pulses. In the output device, the charge signals are converted into voltage signals, and are then amplified and modified into those having lower impedance to output. The analog signals thus obtained are converted into digital signals by subjecting the analog signals to the well-known image processing, and are then outputted to the printer part A. In other words, the image information on the copy G is read out as electric digital image signals (image signals) by the image reader part B in chronological order in an optoelectronic manner.

Figure 7:
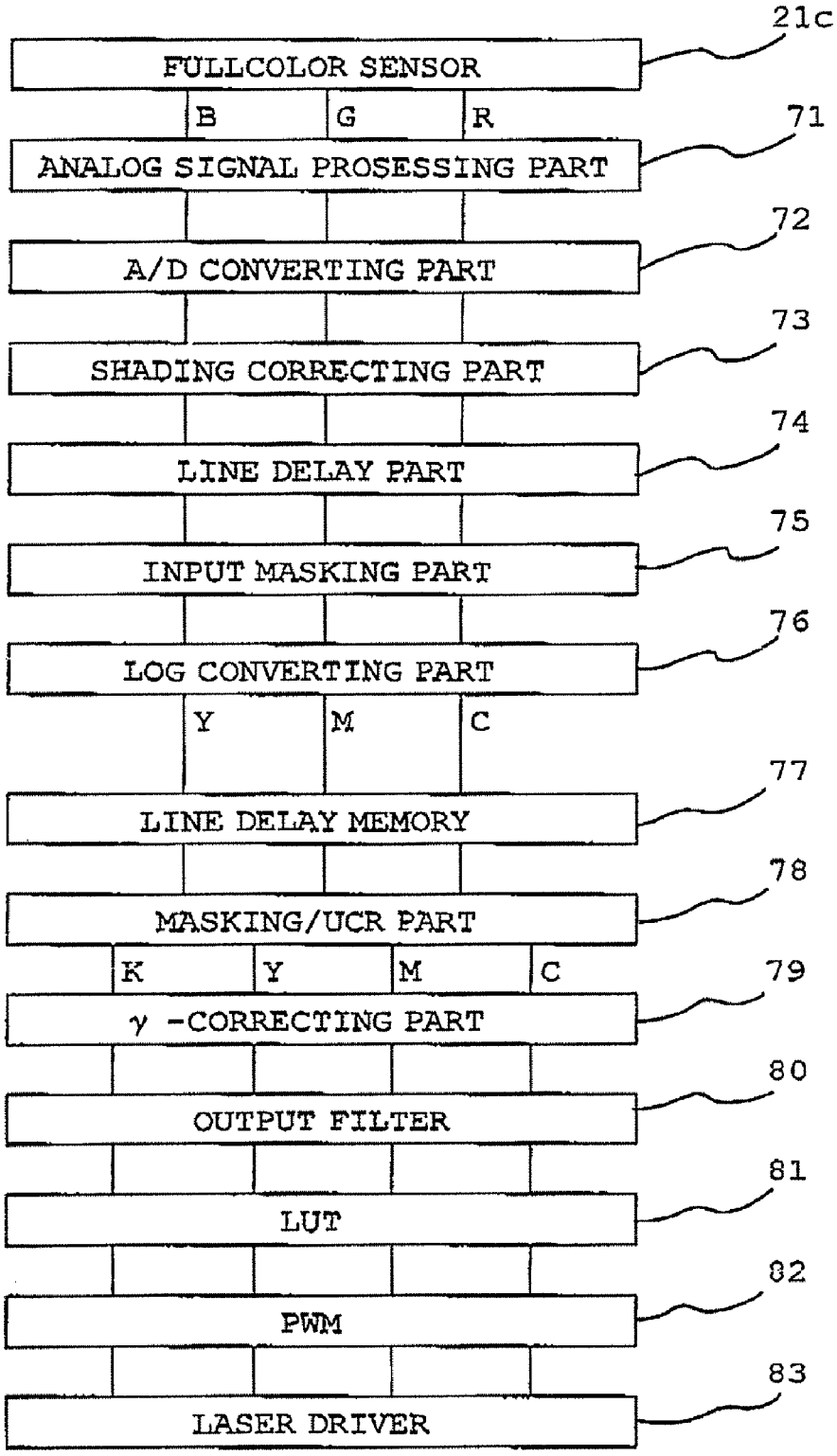
FIG. 7 is a block diagram showing an example of image processing through the image forming apparatus shown in FIG. 6.

Referring now to FIG. 7, there is shown a block diagram that illustrates the steps of image processing. The image signals outputted from the fullcolor sensor 21*c* are introduced into the analog signal processing part 71, in which the gain and offset of the signal are adjusted. Then, the analog signals are converted into the respective colors. That is, for example, they are converted into RGB digital signals of 8 bits (0 to 255 levels: 256-level, gradation) in an A/D converting part 72. In a shading correcting part 73, for removing the variations in sensitivities of the respective sensors in the sensor cell group of the CCD sensor aligned in series, the well-known shading correction for optimizing the gain so as to correspond to each of the CCD sensor cells is performed using a signal which is obtained by reading reference white color plate (not shown) for the respective colors.

A line delay part 74 corrects a spatial deviation included in the image signals outputted from the shading correcting part 73. This spatial deviation is caused as a result of the arrangement of the respective line sensors of the fullcolor sensor 21*c* in which the line sensors are arranged with a given distance between the adjacent sensors in the sub-scanning direction. Concretely, the correction of the spatial deviation is performed such that the line delay of each of R (red) and G (green) color component signals is caused in the sub-scanning direction on the basis of the B (blue) color component signal to synchronize the phases of the three color component signals with each other.

An input masking part 75 converts the color space of image signals outputted from the line delay part 74 into the standard color space of NTSC by means of a matrix calculation. In other words, the color space of each color component signal outputted from the fullcolor sensor 21*c* is defined by the spectral characteristics of a filter for the corresponding color component. The input masking part 75 converts the color space into a standard color space of NTSC.

A LOG converting part 76 includes, for example, a look-up table (LUT) constructed of a ROM etc. The LOG converting part 76 coverts RGB luminance signals outputted from the input masking part 75 into CMY density signals. A line delay memory 77 delays the image signals outputted from the LOG converting part 76 by a period equal to the period (line delay) during which control signals UCR, FILTER, SEN, and the like are generated from the outputs of the input masking part 75 by a black character determining part (not shown).

A masking/UCR part 78 extracts black component signals K from image signals outputted from the line delay memory 77. Furthermore, the masking/UCR part 78 conducts the matrix computation for correcting the color turbidity of a recording color material of the printer part on the Y, M, C, and K signals, thereby outputting color component image signals (e.g., 8 bits) in the order of M, C, Y, and K every time the reader part performs a reading operation. It should be noted, the matrix coefficient to be used in the matrix computation is defined by the CPU (not shown).

Next, on the basis of the obtained 8-bit color component image signals (Data), the processing of determining the recording rates Rn, Rt of the respective deep and pale dots is performed. For instance, when the input gradation data (Data) is 100/255, the recording rate Rt of the pale dot is defined as 250/255 and the recording rate Rn of the deep dot is defined as 40/255. Here, the recording rate is represented by an absolute value such that 255 corresponds to 100%.

A γ-correcting part 79 performs a density correction on image signals outputted from the masking/UCR part 78 so as to match the image signals with which ideal gradation characteristics of the printer part can be obtained. An output filter (a space filter processing part) 80 performs both an edge emphasis and a smoothing processing on the image signals outputted from the γ-correcting part 79 in accordance with the control signals from the CPU.

An LUT 81 is provided for making the density of an original image conform with the density of an output image. For instance, the LUT 81 includes a RAM etc. A translation table of the LUT 81 is set by the CPU. A pulse width modulator (PWM) 82 generates a pulse signal having a pulse width corresponding to the level of an input image signal. The pulse signal is inputted into a laser driver 83 that actuates a semiconductor laser (laser source).

Here, a pattern generator (not shown) is mounted on the image forming apparatus, where a gradation pattern is registered so that the signals can be directly passed to the pulse width modulator 82.

The exposure optical device 3 forms an electrostatic charge image by conducting a laser scanning exposure L on the surface of the electrostatic charge image bearing member 1 on the basis of image signals inputted from the image reader unit 21.

Figure 8:
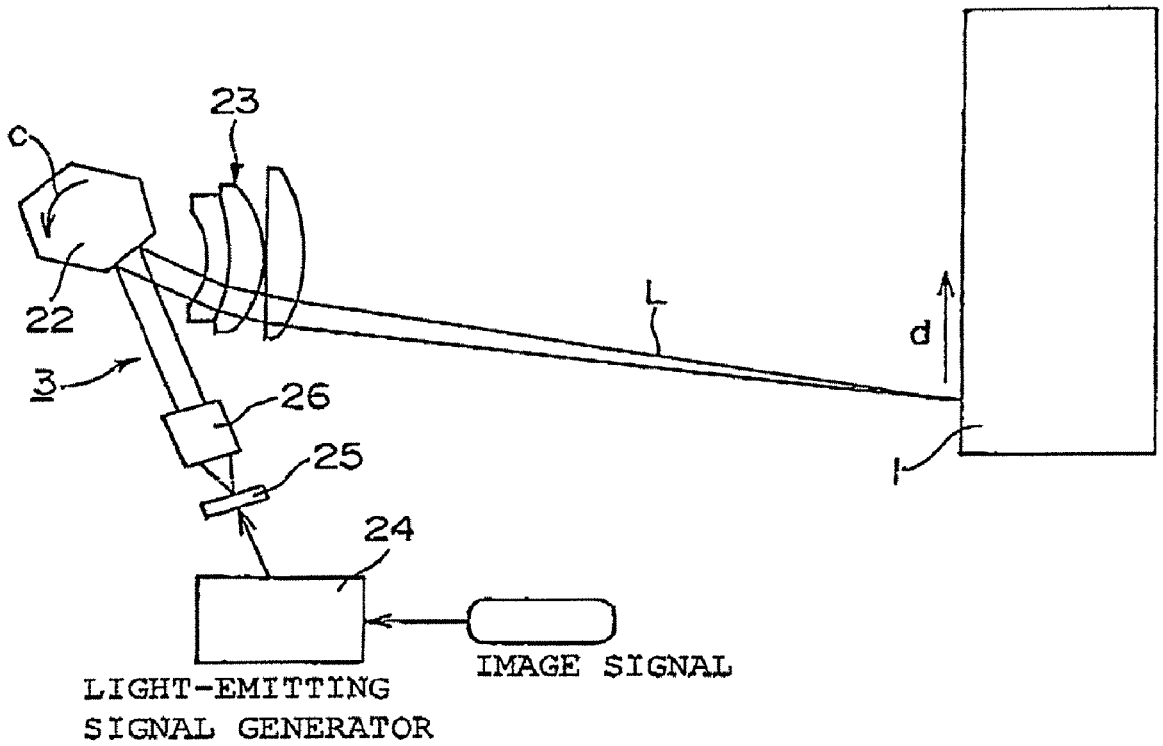
FIG. 8 is a schematic diagram showing a structure of an exposure device of the image forming apparatus shown in FIG. 6.

FIG. 8 is a schematic view for illustrating an exposure optical device 3. When the laser scanning exposure L is performed on the surface of the photosensitive member (electrostatic charge image bearing member) 1 by the exposure optical device 3, a solid laser element 25 is caused to blink (switched on and off) at a predetermined timing by a light-emitting signal generator 24 on the basis of image signals inputted from the image reader unit 21. Then, laser beams provided as optical signals irradiated from a solid laser element 25 are converted into light flux substantially in parallel by a collimator lens system 26. Furthermore, the photosensitive member 1 is scanned in the direction of the arrow d (longitudinal direction) by a polygonal rotating mirror 22 rotated at a high speed in the direction of the arrow c, such that a laser spot s formed on the surface of the photosensitive member 1 by a $f_\theta$ lens group 23 and a reflective mirror 27 (see FIG. 6). Consequently, such a laser scanning movement forms an exposure distribution corresponding to the scanning movement on the surface of the photosensitive member 1. Furthermore, for each of the scanning, an exposure distribution based on the image signals can be formed on the surface of the photosensitive member 1 by vertically scrolling only a predetermined distance for each scanning movement on the surface of the photosensitive member 1.

In other words, the uniform charge surface (for example, being charged to −700 V) of the photosensitive member 1 is scanned light emitted from the solid laser element 25, which emits light by being turned on and off based on the image signals, by the polygonal rotating mirror 22 which is rotated at a high speed. Accordingly, electrostatic charge images of the respective colors corresponding to the scanning exposure patterns are formed on the surface of the photosensitive member 1.

Figure 9:
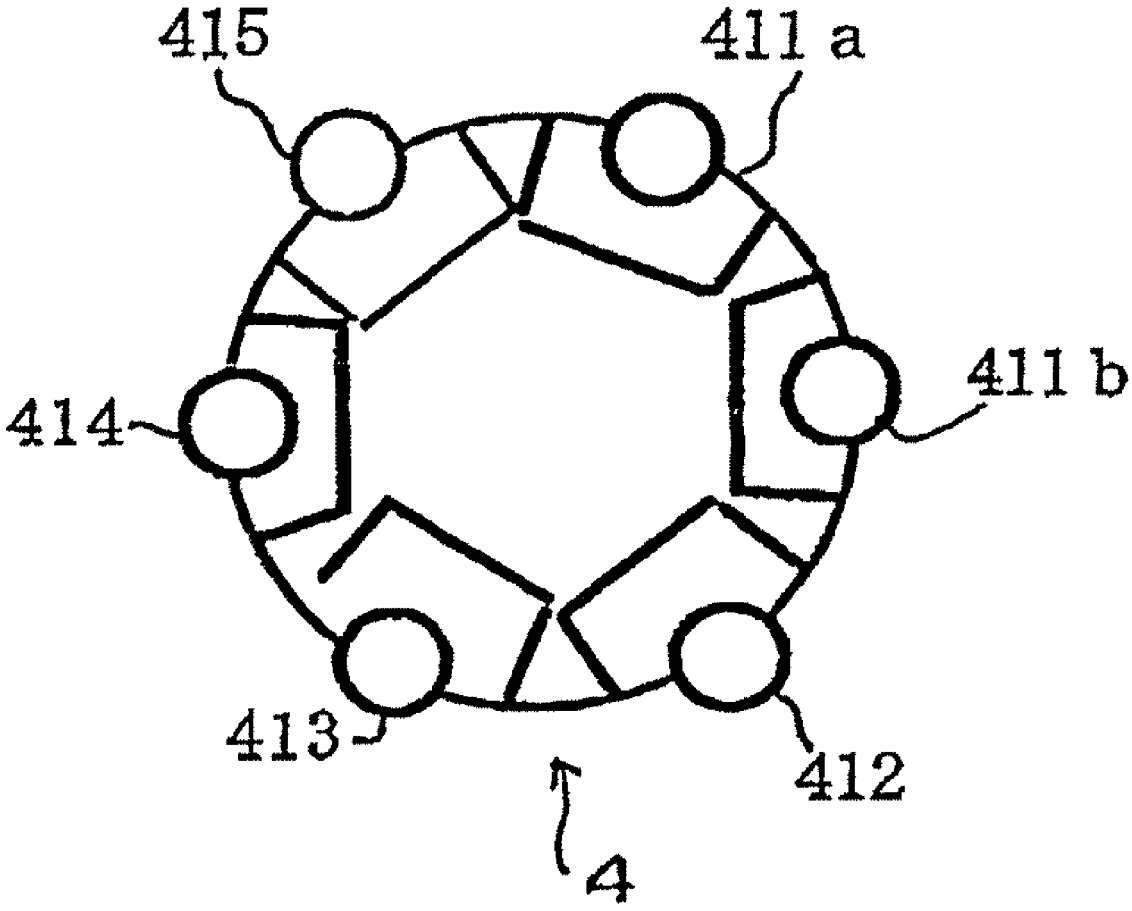
FIG. 9 is a schematic diagram showing a structure of a developing device of the image forming apparatus shown in FIG. 6.

As shown in FIG. 9, the developing apparatus 4 includes developing devices 411*a*, 411*b*, 412, 413, 414, and 415. These developing devices contain a developer having a pale magenta toner, a developer having a deep magenta toner, a developer having a cyan toner, a developer having a yellow toner, and a developer having a black toner, respectively. Each of the developing devices develops an electrostatic charge image formed on the photosensitive member 1 which is as the electrostatic charge image bearing member by a suitable development system which correspond to a kind of the toner, so that each toner image can be formed on the photosensitive member 1. The five kinds of developers concerning the present invention may be introduced in any developing device selected from six different developing devices described above. An order of the colors in not limited. In addition, a remaining developing device may have an additional developer for another pale color toner, a specific color toner such as green, orange, or white, a colorless toner without containing any colorant, or the like. As these developing devices, a two-component developing device shown in FIG. 10 is one of preferable examples.

Figure 10:
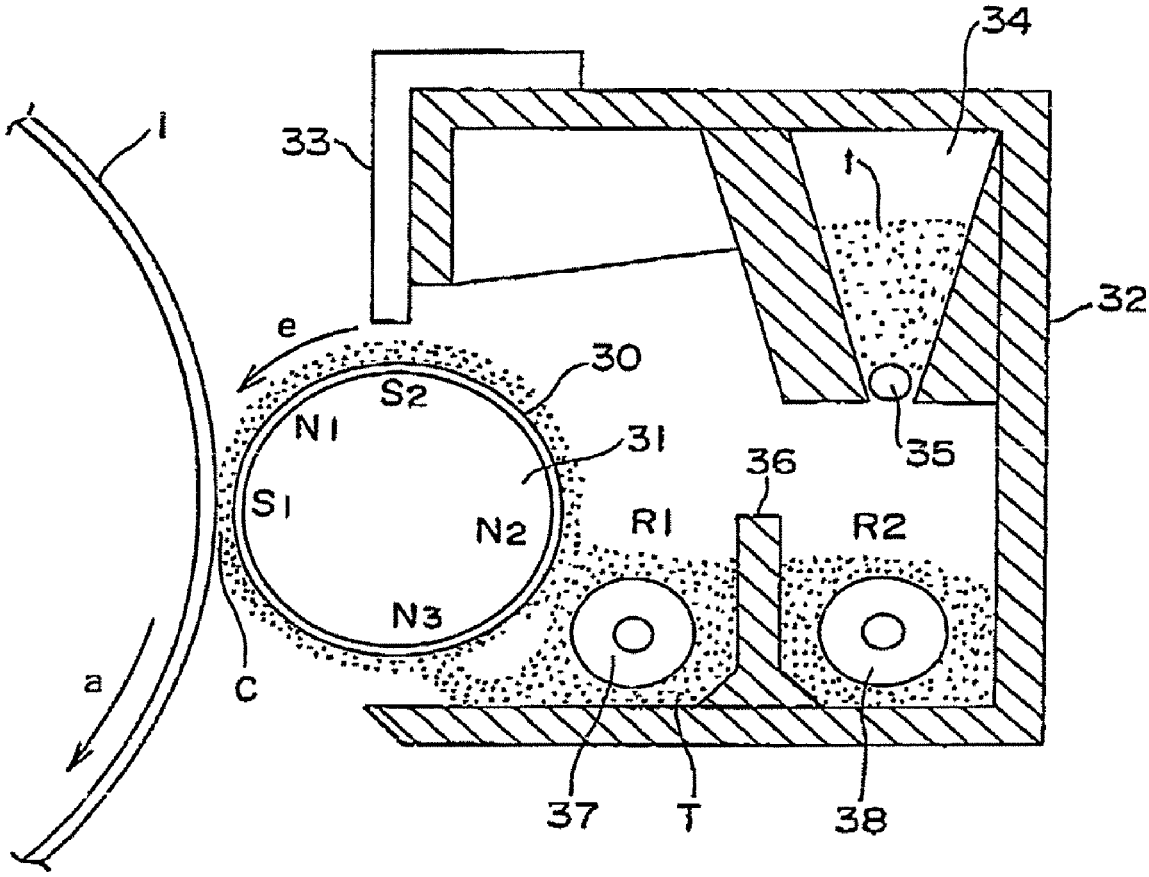
FIG. 10 is a schematic diagram showing an example of a structure of a developing unit of the developing device shown in FIG. 9.

In FIG. 10, the two-component developing device includes a developing sleeve 30 which can be driven to rotate in the direction of the arrow e. In the developing sleeve 30, a magnetic roller 31 is fixed in place. A developer container 32 is provided with a restricting blade 33 (non-magnetic metal plate provided with a space from the surface of the developing sleeve 30) for forming a thin layer of a developer T on the surface of the developing sleeve 30. The developer T is a mixture of the above toner and magnetic carrier particles.

Furthermore, the inside of the developing container 32 is partitioned into a developing chamber (a first chamber) R1 and a stirring chamber (a second chamber) R2 by a partition wall 36. A toner hopper 34 is arranged above the stirring chamber R2. Transfer screws 37, 38 are arranged in the developing chamber R1 and the stirring chamber R2, respectively. Furthermore, a supply port 35 is formed in the toner hopper 34, so that a toner t can be dropped and supplied into the stirring chamber R2 through the supply port 35 at the time of supplying the toner t.

Furthermore, the developer T in the developing chamber R1 is transferred in the longitudinal direction of the developing sleeve 30 by a rotary movement of the transfer screw 37. The developer T in the stirring chamber R2 is transferred in the longitudinal direction of the developing sleeve 30 by a rotary movement of the transfer screw 38. The direction in which the developer is carried by the transfer screw 38 is opposite to that by the transfer screw 37.

The partition wall 36 has openings (not shown) on the near side and the back side extending in the direction perpendicular to the plane of the figure. The developer T transferred by the transfer screw 37 is transferred from one of the openings to the transfer screw 38, while the developer T transferred by the transfer screw 38 is transferred from the other of the openings to the transfer screw 37. Consequently, the toner is charged and polarized by friction with the magnetic particles for allowing the development of a latent image.

The developing sleeve 30 made of a non-magnetic material such as aluminum or non-magnetic stainless steel is placed in the opening formed in a portion near the photosensitive member 1 of the developing container 32. The developing sleeve 30 rotates in the direction of the arrow e (counterclockwise) to carry the developer T containing the toner and the carrier to the developing part C. A magnetic brush for the developer T supported by the developing sleeve 30 is brought into contact with the photosensitive member 1 being rotated in the direction of the arrow c (clockwise) in the developing part C and the electrostatic charge image is developed in the developing part C.

An oscillation bias voltage where a direct voltage is superimposed on an alternating voltage is applied on the developing sleeve 30 from a power source (not shown). A dark potential (the potential of the non-exposed portion) and a light potential (the potential of the exposed portion) of the latent image are positioned between the maximum value and the minimum value of the above oscillation bias voltage. Consequently, an alternating electric field alternately changing its direction is formed in the developing part C. In the alternating electric field, the toner and the carrier vibrate violently enough to allow the toner to throw off the electrostatic constraint to the developing sleeve 30 and the carrier. Consequently, the toner adheres to the light portion of the surface of the photosensitive member 1 for the latent image.

The difference (peak-to-peak voltage) between the maximum and the minimum values of the above oscillation bias voltage is preferably in the range of 1 to 5 kV (e.g., a rectangular wave of 2 kV) In addition, the frequency is preferably in the range of 1 to 10 kHz. Furthermore, the waveform of the oscillation bias voltage is not limited to a rectangular wave. A sine waveform or a triangular waveform may be also used.

Furthermore, the value of the above direct voltage component is a value between the dark potential and the light potential of the electrostatic charge image. Preferably, for preventing the adhesion of toner that causes fogging to the dark potential area, such a value may be nearer the value of the dark potential than the value of the light potential which is the minimum when expressed by the absolute value. For the concrete values of the developing bias and the potential of the electrostatic charge image, for example, a dark potential is −700 V, a light potential is −200 V, and a direct current component of the developing bias is −500 V. In addition, it is preferable that aluminium space (the minimum space position is located in the developing portion C) between the developing sleeve 30 and the electrostatic charge image bearing member 1 is in the range of 0.2 to 1 mm (e.g., 0.5 mm).

In addition, the amount of the developer T to be transferred to the developing part C by being restricted by the restricting blade 33 is preferably defined such that the height of the magnetic blush of the developer T on the surface of the developing sleeve 30, which is formed due to the magnetic field in the developing part C by a developing magnetic pole S1 of the magnetic roller 31, becomes 1.2 to 3 folds of the minimum space between the developing sleeve 30 and the photoseneitive member 1 under the condition in which the photosensitive member 1 is removed. For example, if the minimum space is 500 μm, the height can become 700 μm.

The developing magnetic pole S1 of the magnetic roller 31 is arranged at a position opposite to the developing portion C. The developing magnetic pole S1 forms a developing magnetic field in the developing part C to allow the formation of a magnetic brush of the developer T. Then, the magnetic brush is brought into contact with the photosensitive member 1 to develop a dot-distributed electrostatic charge image. At this time, the toner adhered on the ears (brush) of the magnetic carrier and the toner adhered on the surface of the sleeve instead of the ears are transferred to the exposure portion of the electrostatic charge image to develop the electrostatic charge image. A strength of the developing magnetic field formed by the developing magnetic pole S1 on the surface of the developing sleeve 30 (a magnetic flux density in the direction perpendicular to the surface of the developing sleeve 30) preferably has a peak value in the range of $5\times10^{-2}$ (T) to $2\times10^{-1}$ (T). In addition, the magnetic roller 31 includes N1, N2, N3, and S2 poles in addition to the abode developing magnetic pole S1.

Here, the developing step for actualizing the electrostatic charge image on the photosensitive member 1 by a two-component magnetic brush method using a developing apparatus 4 and a circulating system of the developer T will be described below.

The developer T being drawn by a rotary motion of the developing sleeve 30 at the N2 pole is transferred from the S2 pole to the N1 pole. In the middle of the transfer, the restricting blade 33 restricts the layer thickness of the developer to form a thin-layered developer. Then, the brushed developer T in the magnetic field of the developing magnetic pole S1 develops the electrostatic charge image on the photosensitive member 1. Subsequently, the developer T on the developing sleeve 30 is dropped in the developing chamber R1 by the repulsive magnetic field between the N3 pole and the N2 pole, The developer T being dropped in the developing chamber R1 is stirred and carried by the transfer screw 37.

The present invention can adopt a general material for the intermediate transfer member and the transferring means.

The transfer member 5 has a transfer sheet 5*c* being stretched over the surface thereof. The transfer sheet 5*c* is made of a polyethylene terephthalate resin film or the like. Also, the transfer sheet 5*c* is disposed so as to be capable of being brought into contact with and separated from the photosensitive member 1 adjustably. The transfer member 5 is rotationally driven in the direction of the arrow (clockwise). In the transfer member 5, the transfer charger 5*a*, a separation electric charger 5*b*, and the like are installed.

Next, the image forming operation of the image forming apparatus described above will be mentioned.

The photosensitive member 1 is rotationally driven around a center shaft at a predetermined peripheral velocity (process speed) in the direction of the arrow a (counterclockwise). During the rotation, the photosensitive member 1 receives a uniform charging treatment with a negative polarity in the present embodiment by a primary electric charger 2.

Subsequently, a scanning exposure light L with a laser beam being modified on the basis of image signals to be outputted from the image reader part B to the printer part A is outputted from an exposure optical device (a laser scanning device) 3 to the uniformly charged surface of the photosensitive member 1 to sequentially form electrostatic charge images of each color corresponding to the image information on the copy G read out by the image reader part B photoelectrically on the photosensitive member 1. The electrostatic charge image formed on the photosensitive member 1 is visualized by the developing apparatus 4 with the above two-component magnetic brush method. At first, the electrostatic charge image is subjected to a reversal development with the developing device 411*a* to visualize it as a first color toner image.

On the other hand, in sync with the formation of the above toner image on the photosensitive member 1, a transfer material P such as a sheet of paper being stored in a feeder cassette 10 is fed one by one with a feed roller 11 or 12, followed by feeding to a transfer member 5 by a resist roller 13 at a predetermined timing. Subsequently, the transfer material P is electrostatically adsorbed on the transfer member 5 by an adsorption roller 14. The transfer material P being electrostatically adsorbed on the transfer member 5 is shifted to a position facing the photosensitive member 1 by a rotary motion of the transfer member 5 in the direction of the arrow (clockwise). Then, a transfer charger 5*a* provides the back side of the transfer material P with charges having polarity opposite to the above toner, transferring a toner image from the photosensitive member 1 to the front side of the transfer material P.

The remaining toner on the photosensitive member 1 after the transfer is removed by a cleaning device 6. Then, the surface of the photosensitive member 1 is subjected to charge-removal by a pre-exposure optical lump 7. Then, the photosensitive member 1 is used for the subsequent toner image formation.

Hereinafter, in the same manner as described above, the electrostatic charge image on the photosensitive member 1 is developed, and each of pale magenta toner image, deep magenta toner image, cyan toner image, yellow toner image, and black toner image formed on the photosensitive member 1 is transferred and overlapped on the transfer material P on the transfer member 5 by the transfer charger 5*a* to form a full-color image.

Then, the transfer material P is separated from the transfer member 5 by the separation electric charger 5*b*, followed by carrying the separated transfer material P to a fixing device 9 via a transfer belt 8. The transfer material P being carried to the fixing device 9 is heated and pressurized between a fixing roller 9*a* and a pressurizing roller 9*b* to fix a full-color image on the surface of the transfer material P. Subsequently, the transfer material P is discharged on a tray 16 by a discharge roller 15.

A toner image of each color can be directly transferred to a transfer material by using an image forming apparatus (so-called tandem-type image forming apparatus) comprising, for example: plural (for number of kinds of toners) electrostatic charge image bearing members; plural charge means of the electrostatic charge image bearing member; plural exposure device; plural developing device; plural transfer means provided corresponding to the electrostatic charge image bearing members; plural cleaning devices; a carry means for sequentially carrying one transfer material to a transfer position of the transfer means; and a fixing device, although not shown. Thus, an image using two or more kinds of the toners can be formed without using the transfer member 5 (or intermediate transfer member).

Next, a preferable method of measuring each physical property of the magenta toner of the present invention is described below.

Measurement of Molecular Weight of Toner, Binder Resin and Wax Dispersion Medium by GPC As described below, a molecular weight distribution of the toner, the binder resin, and the wax dispersion medium by GPC can be determined through measurement by GPC using THF soluble matter obtained by dissolving a sample as a measuring object in a THF solvent.

In other words, a sample is placed in THF, and the mixture is left for several hours. After that, the mixture is sufficiently shaken to mix the sample and THF (until a coalesced product of the sample disappears) and the mixture is left for an additional 12 or more hours. At this time, a time period during which the sample is left in THF should be 24 hours or more. Then, the mixture is passed through a sample treatment filter (having a pore size of 0.45 to 0.5 μm, for example, Mishoridisk H-25-5 manufactured by Tosoh Corporation or Ekicrodisk 25 CR manufactured by Gelman Science Japan) to prepare a sample for GPC measurement. Moreover, the sample concentration is adjusted such that the amount of the resin component is 0.5 to 5 mg/ml. GPC measurement of the sample prepared by the above method is as follows. A column is stabilized in a heat chamber at 40° C., and tetrahydrofuran (THF) to serve as a solvent is flown to the column stabilized at the temperature at a flow velocity of 1 ml/min. Then, about 50 to 200 μl of the THF sample solution of a resin adjusted to a sample concentration of 0.05 to 0.6% by mass is injected for measurement.

A combination of multiple commercially available polystyrene gel columns is recommended for the column in order to accurately measure a molecular weight region of $10^3$ to $2\times10^6$. Examples of the combination include: a combination of shodex GPC KF-801, 802, 803, 804, 805, 806, and 807 manufactured by Showa Denko; and a combination of μ-styragel 500, $10^3$, $10^4$, and $10^5$ manufactured by Waters. An RI (refractive index) detector is used as a detector.

In measuring a molecular weight of the sample, a molecular weight distribution of the sample is calculated from a relationship between a logarithmic value in a calibration curve created by several kinds of monodisperse polystyrene standard samples and a count number (retention time). Examples of a standard polystyrene sample used for a calibration curve include a standard polystyrene sample having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, or $4.48\times10^6$ (manufactured by Tosoh Corporation or Pressure Chemical Co.). Preferably, at least about 10 standard polystyrene samples are used in combination.

| | |
|---|---|
| Device: | GPC-150 (Waters Corporation) |
| Column: | GMH-HT 30 cm double (manufactured by Tosoh Corporation) |
| Temperature: | 135° C. |
| Solvent: | o-dichlorobenzene (added with 0.1% by mass of ionol (a trade name)) |
| Flow Rate: | 1.0 ml/min |
| Sample: | 0.4 ml of a 0.15% sample is injected |

Measurement is performed under the above conditions, and a molecular weight calibration curve prepared by monodisperse polystyrene standard samples is used in calculating the molecular weight of the sample. Furthermore, the molecular weight of the sample is calculated by subjecting the molecular weight to polyethylene conversion by using a conversion equation derived from the Mark-Houwink viscosity equation.

Measurement of Maximum Temperature of Largest Endothermic Peak of Toner, Wax, etc.

The largest endothermic peaks of the toner and wax can be measured using a differential scanning calorimeter (DSC measuring device), DCS-7 (from Perkin Elmer, Inc.), or DSC2920 (from TA Instruments Japan). The measurement method is to be in conformance with ASTM D3418-82.

5 to 20 mg, preferably 10 mg of the sample to be measured is prepared by precise weighting. The measured sample is put into an aluminum pan, and using an empty aluminum pan as a reference, the measurement is performed under an ordinary temperature and an ordinary humidity within a measurement range of 30 to 200° C. and at a rate of temperature increase of 10° C./min.

Temperature Curve:

Temperature rise I (from 30° C. to 200° C., rate of temperature increase 10° C./min)

Temperature decrease I (from 200° C. to 30° C., rate of temperature decrease 10° C./min)

Temperature rise II (from 30° C. to 200° C., rate of temperature increase 10° C./min)

As the largest endothermic peaks of the toner and wax, in the process of temperature increase II, one having, in a region not lower than the endothermic peak of Tg of resin, the largest height from the base line, or in the case where it is difficult to discriminate the endothermic peak of Tg of resin since it overlaps another endothermic peak, the highest one of the overlapping peaks, is taken as the largest endothermic peak.

Measurement of the Dispersion Size of the Colorant Particles

The toner is added to a 2.3 M sucrose solution, followed by sufficient stirring. A small amount of the resulting solution is applied to a sample holder pin, which is subsequently put into liquid $N_2$ to solidify and immediately set on a sample arm head.

Using ultramicrotome FC4E (manufactured by Nissei Sangyo K.K.) provided with a cryogenic device, the solidified product is cut according to a conventional method of preparing samples.

Photographs of the samples are taken using an electron microscope H-8000 Type (manufactured by Hitachi, Ltd.) at an accelerating voltage of 100 kV. Magnifications are arbitrarily set in accordance with the samples.

The image information thus obtained is entered to an image analyzer (Luzex 3, manufactured by Nireco Corporation) through an interface to convert into binary image data. Among the sample, only pigment particles each having a particle size of 0.1 μm or more are analyzed at random, where the measurement is repeated until the sampling has been made over 300 times. Thus, the number average particle size and particle size distribution of the colorant particles necessary for the present invention are determined.

Here, only the particles having a particle size of 0.1 μm or more are used for the measurement. The particle size referred to in the present invention is a value defined by a diameter obtained after approximating the image of each colorant particle to a sphere.

Measurement of the Average Circularity of the Magenta Toner

The average circularity of the magenta toner is measured using a flow particle image measuring device ("FPIA-2100", manufactured by Sysmex Corporation) and calculated using the following equation.

Circle equivalent diameter=(area of projected particle image/Π)$^{1/2}$×2

Circularity=(circumference of a circle having an area identical to that of a projected particle image)/(circumferential length of the projected particle image)

The "area of a projected particle image" refers to an area of a toner particle image binarized, and the "circumferential length of the projected particle image" is defined as a length of a profile line obtained by connecting edge points of the toner particle image. The circumferential length of the particle image obtained by image processing at an image processing resolution of 512×512 (0.3 μm×0.3 μm pixels) is used for the measurement.

The circularity according to the present invention is an index of degree of unevenness of the magenta toner particles. The circularity of 1.000 represents that the toner particles have a shape of a perfect sphere, and a small value of the circularity represents a complex surface shape of the toner.

Further, the average circularity C may be calculated by the following equation using the circularity (central value) ci at a cutoff point i of the particle size distribution and the total particle number m.

$$\text{Average circularity } C = \sum_{i=1}^{m} ci/m$$

The measuring device "FPIA-2100" used in the present invention calculates the average circularity by the following method. That is, the calculated circularity values of each of the particles, for calculation of the average circularity, are equally divided into classes by 0.01 in the circularity range of 0.4 to 1.0 according to the measured circularity. The average circularity is determined using a central value of the circularity of each class and the number of the measured particles of the class.

A specific method of measuring the circularity is as follows. A surfactant, preferably alkylbenzenesulfonate, as a dispersant is added to 10 ml of ion-exchanged water with solid impurities removed, preliminarily prepared in a vessel. Subsequently, 0.02 g of a measuring sample is further added to this solution and uniformly dispersed. An ultrasonic disperser such as "Tetora150" (manufactured by Nikkaki Bios Co., Ltd.) may be used as a dispersing means for subjecting the sample to 2-minute dispersion to prepare a dispersion liquid for the measurement. At this time, temperature of the dispersion liquid is arbitrary cooled so that the temperature does not increase to 40° C. or above. The environment around the device installed is controlled to 23° C.±0.5° C. so that temperature inside the flow particle image measuring device "FPIA-2100" becomes 26 to 27° C., to suppress variation in circularities. The device is automatically focused using 2-μm latex particles at regular time intervals, preferably every 2 hours.

The flow particle image measuring device is used for the circularity measurement of the magenta toner particles, and 1,000 or more toner particles are measured by readjusting the toner particle concentration in the dispersion to 3,000 to 10,000 particles/μl as measured. After the measurement, the average circularity of the magenta toner particles is determined using the data, omitting the data below circle equivalent diameter of 2 μm.

Further, the measuring device "FPIA-2100" used in the present invention has an increased measuring accuracy of the toner shape compared to "FPIA-1000" conventionally used for calculating the toner shape, owing to improvements in the magnification of processed particle images and in the processing resolution of images captured in (256×256 to 512×512), thereby achieving more reliable trapping of fine particles. Therefore, when the particle shape must be more accurately measured as in the present invention, FPIA-2100 is more useful for providing more accurate information regarding the particle shape.

Figure 2:
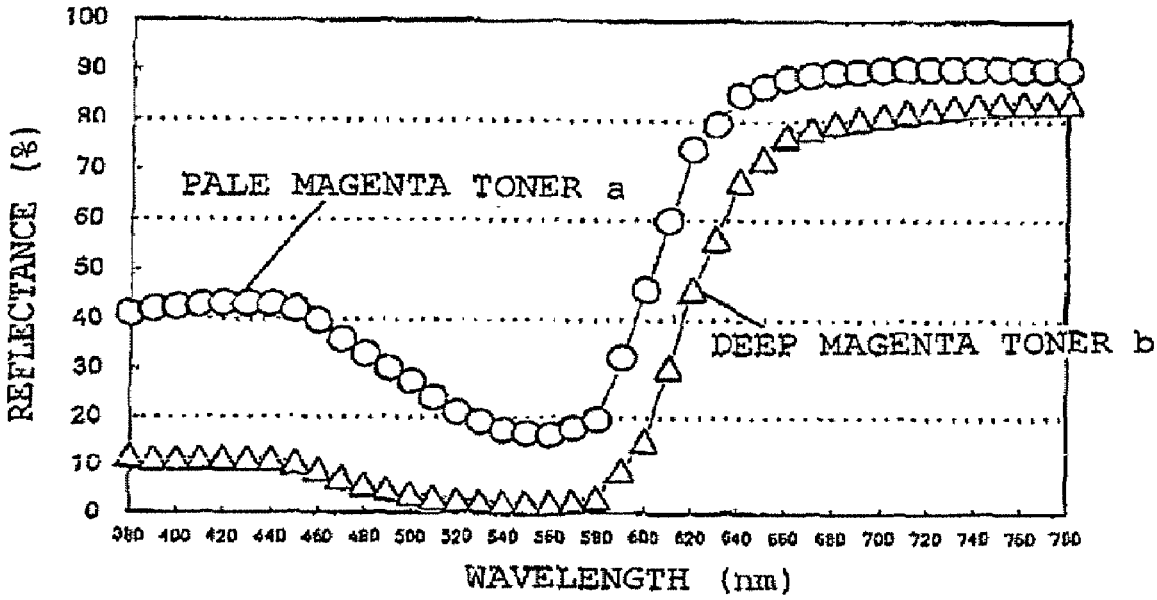
FIG. 2 is a diagram showing an example of measurement results of a spectroscopic analysis of a magenta toner of the present invention in a powder form (pale magenta toner) and a magenta toner in a powder form (deep magenta toner) having lower reflectance than the pale magenta toner.

Measurement of the Spectral Sensitivity Distribution of the Toner in a Powder Form The lightness L* and spectral sensitivity of the magenta toner in a powder form are measured using a spectral differential calorimeter "SE-2000" (manufactured by Nippon Denshoku Industries Co., Ltd.) according to JIS Z-8722 under conditions of C illuminant and 2° field. The measurement is carried out following the instruction attached to the device, but a reference plate is preferably standardized using a glass of 2 mm thickness and 30 mm diameter within an optional powder measurement cell. To be more specific, the measurement is carried out in a state where the cell filled with the sample powder is placed on a powder sample holder (attachment) of the spectral differential calorimeter. The lightness and spectral distribution are measured by filling 80% or more of a cell inner volume with the powder sample and subjecting the sample to shaking of 1 cm shake width at 1 shake/second for 30 seconds on a shake table before placing on the powder sample holder. FIG. 2 shows a measurement result of spectral sensitivity distribution plotting the obtained reflectance on the ordinate axis and a wavelength of the reflected light on the abscissa axis, using an example of the magenta toner in a powder form (pale magenta toner) of the present invention and an example of a deep magenta toner in a powder form having lower lightness than that of the pale magenta toner. The reflectance at a wavelength of 480 nm and a wavelength of 630 nm can be easily determined by plotting a graph such as the result of FIG. 2.

Measurement of the L*, a*, and b* Values of the Toner in a Fixed Image

The L*, a*, and b* values of the toner in a fixed image are determined, for example, by: introducing the toner to a commercially-available plain paper full-color copier (Color Laser Copier "CLC1150", manufactured by Canon Inc.), using plain paper (Color Laser Copier Paper "TKCLA4", available from Canon Inc.) as a transfer material; and measuring 200-line, 16-gradation images, formed by changing the toner amount on the paper using SpectroScan Transmission (manufactured by GretagMacbeth Co., Ltd.). Hereinafter, an example of specific measurement conditions is shown.

<Measurement Conditions>

Observation light source: D50

Observation visual field: 2°

Density: DIN NB

White reference: Pap

Filter: none

Figure 3:
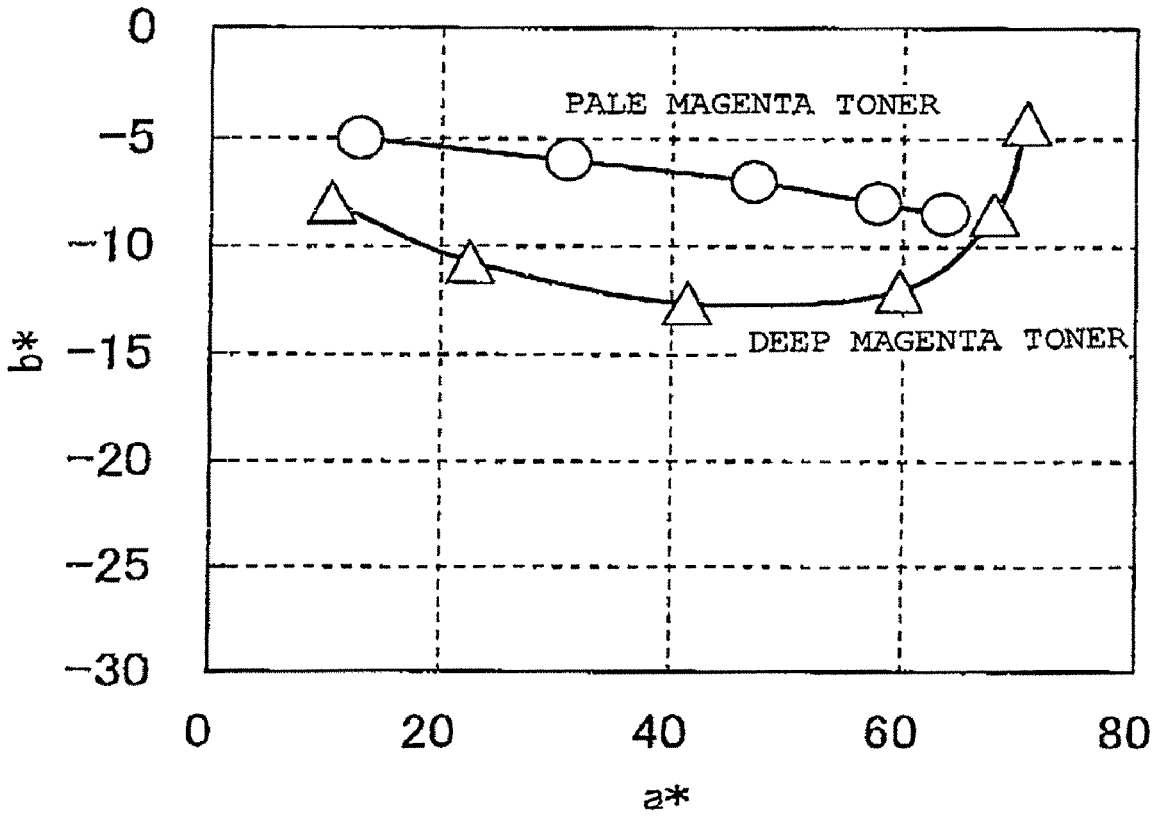
FIG. 3 is a diagram showing an example of a result of a hue measurement of an image formed using the magenta toner (pale magenta toner) of the present invention and a magenta toner (deep magenta toner) having lower reflectance than the pale magenta toner.

FIG. 3 shows an a*-b* coordinate figure obtained by plotting the a* and b* values measured using an example of the pale magenta toner (pale magenta toner) of the present invention and a deep magenta toner having lower lightness than that of the pale magenta toner on the abscissa axis and the ordinate axis, respectively.

Method of Measuring Viscoelasticity of Toner

A toner is molded under pressure into a disk-like sample having a diameter of 8 mm and a thickness of about 2 to 3 mm. Then, the sample is set in a parallel plate, and is heated in the temperature range of 50 to 200° C. to carry out temperature dispersion measurement. The rate of temperature increase is set to 2° C./min, the angular frequency (ω) is fixed to 6.28 rad/sec, and the distortion factor is automatically set. Temperatures are represented in an axis of abscissa, whereas storage elastic moduli (G') are represented in an axis of ordinate. Then, a value at each temperature is read. ARES (a viscoelasticity-measurement apparatus; manufactured by TA Instruments Japan Inc.) is used for the measurement.

Measurement of the Deformation Rates (R200 and R500) of the Toner

The toner is molded into a cylindrical sample having a diameter of 25 mm and a height of 10 to 11 mm by pressing 5.0 to 5.5 g of the toner at a pressure of $8.0\times10^6$ Pa for 2 minutes using a pellet molding machine. "ARES" (a viscoelasticity-measurement apparatus, manufactured by TA Instruments Japan Inc.) provided with a stainless-steel parallel plate having a diameter of 25 mm and coated with PTFE is used for the measurement.

The deformation rate is measured using the parallel plate having a diameter of 25 mm and coated with PTFE. The molded sample of the toner is placed on the parallel plate, and the temperature of a jig is controlled to 120° C. After it has been confirmed that the sample temperature reached 120° C., a sample height (gap) is adjusted to 10.000 mm. Rate Mode Test is selected for Multiple Extension Mode Test, and the molded sample of the toner is compressed at a Rate of −0.5 mm/s to measure a relationship between the sample height (gap) and a load required for compressing the sample at a constant speed (referred to as Normal Force).

The deformation rate (R200) can be calculated from the following equation using the sample height (gap) of G200

(mm) at a Normal Force of load 200 g (pressure of $4.0\times10^3$ Pa).

$$R_{200} = \frac{10.000 - G_{200}}{10.000} \times 100$$

Similarly, the deformation rate (R500) can be calculated using the sample height (gap) of G500 at a Normal Force of load 500 g (pressure of $1.0\times10^4$ Pa).

EXAMPLES

Hereinafter, the present invention will be specifically described by way of production examples and examples, but those examples will not in any way restrict the present invention.

Production Example of Hybrid Resin (I)

2.0 mol of styrene, 0.21 mol of 2-ethylhexylacrylate, 0.16 mol of fumaric acid, 0.03 mol of α-methylstyrene dimer, and 0.05 mol of dicumylperoxide were placed in a dropping funnel as materials for a vinyl-based copolymer unit. Further, 7.0 mol of polyoxypropylene(2.2)-2,2-bis(4-hydroxyphenyl) propane, 3.0 mol of polyoxyethylene(2.2)-2,2-bis(4-hydroxyphenyl)propane, 3.0 mol of terephthalic acid, 2.0 mol of trimellitic anhydride, 5.0 fumaric acid, and 0.2 g of dibutyltin oxide were placed in a 4-1 glass four-necked flask as materials for a polyester unit. A thermometer, a stirring rod, a condenser, and a nitrogen-introducing tube were attached to the four-necked flask, and the four-necked flask was placed in a mantle heater. After air in the four-necked flask was replaced with nitrogen gas, the mixture was gradually heated under stirring. Stirring at 140° C., the monomers of the vinyl-based copolymer and a polymerization initiator were dropped from the dropping funnel in 4 hours Then, the mixture was heated to 200° C. for a reaction for 4 hours, to thereby obtain a hybrid resin (I) Table 1 shows results of molecular weight measurement of the hybrid resin (I) using GPC.

Production Example of Polyester Resin (I)

3.5 mol of polyoxypropylene(2.2)-2,2-bis(4-hydroxyphenyl)propane, 1.5 mol of polyoxyethylene(2.2)-2,2-bis(4-hydroxyphenyl)propane, 1.5 mol of terephthalic acid, 1.0 mol of trimellitic anhydride, 2.5 mol of fumaric acid, and 0.1 g of dibutyltin oxide were placed in a 4-1 glass four-necked flask. A thermometer, a stirring rod, a condenser, and a nitrogen-introducing tube were attached to the four-necked flask, and the four-necked flask was placed in a mantle heater. The mixture was reacted at 220° C. for 5 hours under a nitrogen atmosphere, to thereby obtain a polyester resin (I) Table 1 shows results of molecular weight measurement of the polyester resin (I) using GPC.

Production Example of Polyester Resin (II)

2.5 mol of polyoxypropylene(2.2)-2,2-bis(4-hydroxyphenyl)propane, 1.5 mol of polyoxyethylene(2.2)-2,2-bis(4-hydroxyphenyl)propane, 1.5 mol of terephthalic acid, 5.0 mol of trimellitic anhydride, 2.5 mol of fumaric acid, and 0.1 g of dibutyltin oxide were placed in a 4-1 glass four-necked flask. A thermometer, a stirring rod, a condenser, and a nitrogen-introducing tube were attached to the four-necked flask, and the four-necked flask was placed in a mantle heater. The mixture was reacted at 220° C. for 5 hours under a nitrogen atmosphere, to thereby obtain a polyester resin (II). Table 1 shows results of molecular weight measurement of the polyester resin (II) using GPC.

Production Example of Polyester Resin (III)

5.0 mol of polyoxypropylene(2.2)-2,2-bis(4-hydroxyphenyl)propane, 2.5 mol of terephthalic acid, 2.5 mol of fumaric acid, and 0.1 g of dibutyltin oxide were placed in a 4-1 glass four-necked flask. A thermometer, a stirring rod, a condenser, and a nitrogen-introducing tube were attached to the four-necked flask, and the four-necked flask was placed in a mantle heater. The mixture was reacted at 220° C. for 5 hours under a nitrogen atmosphere, to thereby obtain a polyester resin (III). Table 1 shows results of molecular weight measurement of the polyester resin (III) using GPC.

Production Example of Vinyl-based Resin (I)

| | |
|---|---|
| Styrene | 70 parts by mass |
| n-Butyl acrylate | 24 parts by mass |
| Monobutyl maleate | 6 parts by mass |
| 2,2-Bis(4,4-di-t-butylperoxycyclohexyl)propane | 1 part by mass |

200 parts by mass of xylene were placed into a four-necked flask. Then, the air in the flask was sufficiently replaced by nitrogen while the xylene was stirred. After the xylene had been heated to 120° C., each of the above components was dropped into the four-necked flask in 3.5 hours. Further, polymerization was completed under reflux of xylene and the solvent was distilled off under reduced pressure, to thereby obtain a vinyl-based resin (I). Table 1 shows results of molecular weight measurement of the vinyl-based resin (I) using GPC.

TABLE 1

| Kind | Mw | Mn | Mw/Mn |
|---|---|---|---|
| Hybrid resin (I) | 68,000 | 3,400 | 20.00 |
| Polyester resin (I) | 32,000 | 2,800 | 11.43 |
| Polyester resin (II) | 85,000 | 3,300 | 25.76 |
| Polyester resin (III) | 5,200 | 2,200 | 2.36 |
| Vinyl-based resin (I) | 285,000 | 6,500 | 43.85 |

Production Example of Wax Dispersion Medium (I)

600 parts by mass of xylene and 120 parts by mass of low-density polyethylene having the maximum heat-absorption peak temperature of 110° C. were placed in an autoclave provided with a thermometer and a stirrer and sufficiently dissolved. After the air in the autoclave had been replaced with nitrogen, a mixed solution of 1,992 parts by mass of styrene, 168 parts by mass of acrylonitrile, 240 parts by mass of monobutyl maleate, 78 parts by mass of di-t-butylperoxy hexahydroterephthalate, and 455 parts by mass of xylene was dropped into the autoclave at 175° C. in 3 hours. The solution was maintained at this temperature for 30 minutes for polymerization. Then, a solvent was removed, to thereby obtain a wax dispersion medium (I), which is a graft reaction product.

Production Examples of Wax Dispersion Media (II) and (III)

Wax dispersion media (II) and (III) were obtained in the same manner as in the production example of wax dispersion medium (I) described above except that the addition amount of di-t-butylperoxy hexahydroterephthalate was changed to 33 parts by mass and 86 parts by mass, respectively, and polyethylene was changed to one having the maximum heat-absorption peak temperature shown in Table 2.

Production Example of Wax Dispersion Medium (IV)

A wax dispersion medium (IV) was obtained in the same manner as in the production example of wax dispersion medium (I) described above except that acrylonitrile was not used and polyethylene was changed to one having the maximum heat-absorption peak temperature shown in Table 2.

Table 2 shows the molecular weights of the wax dispersion media (I) to (IV) using GPC and the maximum heat-absorption peak temperatures of the used low-density polyethylene using DSC.

TABLE 2

| Kind | Mw | Mn | Mw/Mn | Maximum heat-absorption peak temperature of polyolefin |
|---|---|---|---|---|
| Wax dispersion medium (I) | 15,000 | 3,000 | 5.0 | 110° C. |
| Wax dispersion medium (II) | 80,000 | 5,000 | 16.0 | 90° C. |
| Wax dispersion medium (III) | 20,000 | 1,800 | 11.0 | 128° C. |
| Wax dispersion medium (IV) | 16,000 | 3,200 | 5.0 | 110° C. |

Production Example of Wax Dispersant Masterbatch

Production examples of a wax dispersant and a wax dispersant masterbatch are shown below. Next, a wax (A), which is a purified normal paraffin wax, was dispersed in the wax dispersion medium (I) according to the following blending ratio, to thereby obtain a wax dispersant (I) consisting of the wax (A) and the wax dispersion medium (I).

Table 3 shows kinds and maximum heat-absorption peak temperatures of the waxes used in this example.

| | |
|---|---|
| Wax dispersion medium (I) | 50% by mass |
| Wax (A) | 50% by mass |

TABLE 3

| | Maximum heat-absorption peak temperature | Kinds of wax | Mp | Mw | Mn |
|---|---|---|---|---|---|
| Wax(A) | 75° C. | Purified normal paraffin | 500 | 500 | 380 |
| Wax(B) | 98° C. | Purified Fischer-Tropsch | 820 | 910 | 590 |
| Wax(C) | 83° C. | Carnauba | 540 | 500 | 390 |
| Wax(D) | 110° C. | Polyethylene | 2660 | 8880 | 1010 |
| Wax(E) | 63° C. | Purified normal paraffin | 340 | 320 | 280 |

TABLE 3-continued

| | Maximum heat-absorption peak temperature | Kinds of wax | Mp | Mw | Mn |
|---|---|---|---|---|---|
| Wax(F) | 68° C. | Purified normal paraffin | 390 | 360 | 330 |
| Wax(G) | 102° C. | Purified Fischer-Tropsch | 980 | 1120 | 780 |

The wax dispersant (I) thus obtained was melt-kneaded with the polyester resin (I) using a twin screw extruder according to the following blending ratio, to thereby obtain a masterbatch of the wax dispersant (I).

| | |
|---|---|
| Dispersant of Wax (A) | 50% by mass |
| Polyester resin (I) | 50% by mass |

Example 1

| (First kneading step) | |
|---|---|
| Polyester resin (I) | 70 parts by mass |
| Pasty colorant comprising C.I. Pigment Red 122 and C.I. Pigment Red 57:1 | 100 parts by mass |

The above raw materials were charged in a kneader-type mixer following the above recipe and were heated without pressure while mixing. Pigments in an aqueous phase partitioned or shifted to a molten resin phase at the time when the mixture reached the maximum temperature (naturally determined by the boiling point of a solvent in the paste, about 90 to 100° C. in this case). After the partition or shift of the pigments was observed, the mixture was further heated and melt-kneaded for 30 minutes to sufficiently shift the colorant in the paste. Then, the mixer was stopped once, and hot water was discharged. The mixture was further heated to 130° C., further heated and melt-kneaded for about 30 minutes to disperse the colorant while distilling off the water content, and was then cooled, to thereby obtain a first kneaded product (I).

The pasty colorant is a pasty colorant mixture obtained without drying a colorant from colorant slurry produced by a known production method. The pasty colorant is a composition containing 30% by mass of solid content and 70% by mass of water. The solid composition of the pasty colorant in the first kneaded product (I) includes 86% by mass of C.I. Pigment Red 122 and 14% by mass of C.I. pigment Red 57:1.

| | |
|---|---|
| Hybrid resin (I) | 100 parts by mass |
| First kneaded product (I) | 2.55 parts by mass |
| Masterbatch of the dispersant of wax (A) | 16 parts by mass (4 parts by mass as wax (A)) |
| Aluminum compound of 3.5-di-t-butyl salicylic acid | 2 parts by mass |

The above materials were sufficiently premixed using a Henschell mixer and melt-kneaded at an arbitrary barrel temperature using a twin screw extruder. After cooling, the mixture was coarsely pulverized to about 1 to 2 mm using a hammer mill and then finely pulverized using an air-jet type fine pulverizer. The finely pulverized product was treated using a surface modification device for classification and surface modification utilizing mechanical impact force shown in FIG. 4, to thereby obtain toner particles having an average circularity of 0.950 for particles with circle equivalent diameters of 2 mm or larger. 1.5 parts by mass of titanium oxide fine particles, having a primary particle size of 50 nm and surface-treated with isobutyl trimethoxysilane, were externally added to and mixed with 100 parts by mass of the toner particles, to thereby obtain a magenta toner a-1 having a weight average particle size of 6.5 μm.

The magenta toner a-1 and ferrite carrier (volume average particle size of 42 μm), surface-coated with a silicone resin, were mixed so that the toner concentration was 6% by mass, to thereby prepare a magenta developer a-1 (pale).

A commercially-available plain paper full-color copier (Color Laser Copier "CLC1150", manufactured by Canon Inc.) remodeled by removing a fixing unit was used as an image forming apparatus. The apparatus is arranged with four developing units around one photosensitive drum and is provided with an intermediate transfer drum. Images are formed by sequentially developing, with each developing unit repeatedly approaching to and separating from the photosensitive drum, and sequentially transferring the images to a transfer material supported on the intermediate transfer drum to thereby perform image formation. The magenta developer a-1 was set in the magenta developing unit of the apparatus. Using plain paper (Color Laser Copier Paper "TKCLA4", available from Canon Inc.) as a transfer material, a 16-gradation unfixed patch image of the magenta toner a-1 was formed with a printer mode.

The unfixed image was fixed onto the transfer material using a remodeled external fixing device, the fixing device using fixing rollers having a rubber layer of 1.5 mm thickness as a substrate and a surface layer comprised by a PFA tube having a thickness of 50 μm and wrapping the rubber layer, and for which a linear pressure was adjusted such that a nip width between the top and bottom fixing rollers was 11 mm.

An image with an optical density of about 0.35 in a low-density region was extracted. A 256×256 pixel area of the halftone patch of the image was read at resolution of 1,000 dpi using a drum scanner, and RGB value of the area was converted into lightness (L*) value.

Then, L* value data was converted into spatial frequency by Fourier transformation. The spatial frequency was multiplied by visual spatial frequency characteristics (VTF) for conversion into visual frequency information. The value was integrated over the whole frequency band, and the resultant value was then defined as roughness. If no image patch with an optical density of 0.35 was available, the lightness of the image with an optical density of 0.35 was calculated using data on several points with optical densities around 0.35.

Graininess (roughness) of those images was evaluated according to rank based on the following criteria.

A: below 22.0 (no roughness at all, very low graininess)
B: 22.1 to 24.0 (practically no roughness, low graininess)
C: 24.1 to 26.0 (slight roughness, graininess not posing problems in practical use)
D: 26.1 to 28.0 (apparent roughness, high graininess)
E: 28.1 or above (much roughness, very high graininess)

An OHP sheet was used instead of the plain paper to fix an unfixed image similarly output using the remodeled external fixing device. Transmittance of the OHP sheet and an image formed on the OHP sheet were measured to determine transparency on the OHP sheet. Shimadzu recording spectrophotometer UV2200 (manufactured by Shimadzu Corporation) was used for measurement of the transmittance. The transmittance of the OHP sheet alone was defined as 100% to measure and evaluate the transmittance of the magenta toner at the maximum-absorbance wavelength of 500 nm. Evaluation criteria are described below.

A: 70% or above (very good transparency)
B; 60% to below 70% (good transparency)
C: 50% to below 60% (transparency not posing problems in practical use)
D: 40% to below 50% (somewhat poor transparency)
E: below 40% (very poor transparency)

The unfixed image was fixed with the remodeled external fixing device using plain paper and manually changing a set temperature to measure a fixing temperature range with a fixing start temperature as a lower limit and an offset starting temperature as an upper limit.

The magenta developer a-1 was introduced to the plain paper full-color copier (Color Laser Copier "CLC1150", manufactured by Canon Inc.) and 200-line, 16-gradation images were formed, using the above plain paper (Color Laser Copier Paper "TKCLA4", available from Canon Inc.) by changing the toner amount on the paper. L* and c* (chroma) values of the obtained image were measured using SpectroScan Transmission (manufactured by GretagMacbeth Co., Ltd.) to evaluate the c* value on the L*-c* coordinate axes at L*=80. The evaluation criteria thereof are described below.

A: 29 or above (very good chroma)
B: 27 to below 29 (good chroma)
C: 25 to below 27 (chroma not posing problems in practical use)
D: 23 to below 25 (somewhat poor chroma)
E: below 23 (very poor chroma)

Table 4 and Table 5 show: kind of the binder resin used for the magenta toner; kind of the wax (including wax dispersant); DSC measurements and average circularity of the magenta toner; kind, content, and number % of particles having a dispersion size of the colorant. Table 6 shows measurements of spectral sensitivity (reflectance measurement values with light of 480 nm and 630 nm wavelength) of the toner in a powder form, L* value thereof, viscoelasticity thereof, and toner deformation rate, further, Table 7 shows evaluation results of: roughness of the patch image with an optical density of about 0.35 when using pale magenta toner alone and of the patch image with an optical density of about 0.8 when using both the pale magenta toner and the deep magenta toner in combination; differential L* values between the pale magenta toner and the deep magenta toner; fixing temperature region; transparency on an OHP sheet; and c* value at L*=80.

The magenta developer of this example proved adequate for practical use in terms of all of roughness, fixing temperature region, transparency through the OHP sheet, and chroma.

Example 2

A magenta toner a-2 was prepared similar to Example 1 except that a wax dispersant masterbatch containing a wax (F) and a wax dispersion medium (II) was used instead of the wax dispersant (I) masterbatch, to thereby obtain a magenta developer a-2. The magenta developer a-2 was evaluated similar to Example 1. Table 7 shows that the magenta developer a-2 had better low-temperature fixability and slightly poor high-temperature offset property compared to those of Example 1 but was within an adequately practical level.

Example 3

A magenta toner a-3 was prepared similar to Example 1 except that a wax dispersant masterbatch containing a wax (G) and a wax dispersion medium (III) was used instead of the wax dispersant (I) masterbatch, to thereby obtain a magenta developer a-3. The magenta developer a-3 was evaluated similar to Example 1. Table 7 shows that the magenta developer a-3 had better high-temperature offset property and slightly poor low-temperature fixability compared to those of Example 1 but was within an adequately practical level.

Example 4

A magenta toner a-4 was prepared similar to Example 1 except that a wax dispersant masterbatch containing a wax (B) and a wax dispersion medium (I) was used instead of the wax dispersant (I) masterbatch and a content of C.I. Pigment Red 122 was changed to 0.8 part by mass, to thereby obtain a magenta developer a-4. The magenta developer a-4 was evaluated similar to Example 1. Table 7 shows that the magenta developer a-4 had slightly poor low-temperature fixability compared to those of Example 1 but was within an adequately practical level.

Example 5

A magenta toner a-5 was prepared similar to Example 1 except that the wax (A) alone was used instead of the wax dispersant (I) masterbatch and C.I. Pigment Red 122 alone was used as a colorant with an amount of 0.7 part by mass, to thereby obtain a magenta developer a-5. The magenta developer a-5 was evaluated similarly to Example 1. Table 7 shows that the magenta developer a-5 had slightly increased roughness and slightly poor transparency on an OHP sheet compared to those of Example 1 but was within an adequately practical level.

Example 6

A magenta toner a-6 was prepared similar to Example 1 except that the polyester resin (I) alone was used as the binder resin and a wax dispersant masterbatch containing a wax (A) and a wax dispersion medium (IV) was used instead of the wax dispersant (I) masterbatch and C.I. Pigment Red 122 alone was used as a colorant with an amount of 1.8 part by mass, to thereby obtain a magenta developer a-6. The magenta developer a-6 was evaluated similarly to Example 1. Table 7 shows that the magenta developer a-6 had slightly increased roughness, slightly poor transparency on an OHP sheet and slightly poor chroma compared to those of Example 1 but was within an adequately practical level.

Example 7

A magenta toner a-7 was prepared similar to Example 1 extent that a mixture containing a hybrid resin (I) and a vinyl resin (I) in a ratio of 7:3 was used as a binder resin and a wax (B) alone was used instead of the wax dispersant (I) masterbatch, to thereby obtain a magenta developer a-7. The magenta developer a-7 was evaluated similarly to Example 1. Table 7 shows that the magenta developer a-7 had poor transparency on an OHP sheet, poor fixing temperature range width, increased roughness, and poor chroma compared to those of Example 1 but was within a practical level.

Example 8

A magenta toner a-8 was prepared similar to Example 1 except that a mixture containing a hybrid resin (I) and a polyester resin (I) in a ratio of 1:1 was used as a binder resin and a wax (C) alone was used instead of the wax dispersant (I) masterbatch and C.I. Pigment Red 122 alone was used as a colorant with an amount of 0.7 part by mass, to thereby obtain a magenta developer a-8. The magenta developer a-8 was evaluated similarly to Example 1. Table 7 shows that the magenta developer a-8 had increased roughness, poor fixing temperature range width, poor transparency on an OHP sheet, and poor chroma compared to those of Example 1 but was within a practical level.

Example 9

A magenta toner a-9 was prepared similar to Example 1 except that a vinyl resin (I) was used as a binder resin, the wax dispersant (I) alone was used without masterbatching, the content of C.I. Pigment Red 122 was changed to 0.3 part by mass, and a colorant to be used in combination was changed to C.I. Pigment Yellow 180, a yellow colorant, with an amount of 0.1 part by mass, to thereby obtain a magenta developer a-9. The magenta developer a-9 was evaluated similarly to Example 1. Table 7 shows that the magenta developer a-9 had low gloss since a vinyl resin alone was used, poor chroma, poor transparency on an OHP sheet, poor fixing temperature range width, and increased roughness compared to those of Example 1, but was within a practical level even combined with the yellow colorant.

Example 10

A magenta toner a-10 was prepared similar to Example 1 except that a mixture containing a polyester resin (I) and a vinyl-based resin (I) in a ratio of 7:3 was used as a binder resin, a colorant to be used in combination was changed to C.I. Pigment Blue 15:3, a blue colorant, and the wax dispersant (I) alone was used without masterbatching instead of the masterbatch containing the wax (A) and the wax dispersant (I), to thereby obtain a magenta developer a-10. The magenta developer a-10 was evaluated similarly to Example 1. Table 7 shows that the magenta developer a-10 had slightly increased roughness, slightly poor fixing temperature range width, slightly poor transparency on an OHP sheet, and slightly poor chroma compared to those of Example 1, but was within a practical level even combined with the blue colorant.

Example 11

A magenta toner a-11 was prepared similar to Example 1 except that a mixture containing a hybrid resin (I), a polyester resin (I), and a vinyl-based resin (I) in a ratio of 5:3:2 was used as a binder resin, to thereby obtain a magenta developer a-11. The magenta developer a-11 was evaluated similarly to Example 1. Table 7 shows that the magenta developer a-11 had slightly increased roughness, slightly poor transparency on an OHP sheet, and slightly poor chroma compared to those of Example 1, but was within a practical level even combined with the blue colorant.

Comparative Example 1

A magenta toner a-12 was prepared similar to Example 1 except that the wax (D) alone was used as the wax, the polyester resin (II) alone was used as the binder resin, and C.I.

Pigment Red 122 alone was used as a colorant with an amount of 0.4 part by mass, to thereby obtain a magenta developer a-12. The magenta developer a-12 was evaluated similarly to Example 1. The table 8 shows that the magenta developer a-12 had increased roughness, thereby providing an image with very conspicuous graininess in the low-density region Further, more toner must be loaded than that of Example 1 and the magenta developer a-12 resulted in very poor fixing temperature range width, transparency on an OHP sheet, and chroma compared to those of Example 1.

Comparative Example 2

A magenta toner a-13 was prepared similar to Example 1 except that the wax (E) alone was used as the wax, the polyester resin (III) alone was used as the binder resin, and C.I. Pigment Red 122 alone was used as a colorant with an amount of 0.4 part by mass, to thereby obtain a magenta developer a-13. The magenta developer a-13 was evaluated similarly to Example 1. During the conglobation of the toner using a surface modification device shown in FIG. 4, exposure of the wax to a toner surface progressed and transfer efficiency reduced as shown in Table 8. As a result, roughness increased and graininess in the low-density region was very high compared to that of Example 1, Further, the magenta developer a-13 had very poor fixing temperature range width and transparency on an OHP sheet compared to those of Example 1.

Comparative Example 3

A magenta toner a-14 was prepared similar to Example 1 except that the wax (D) alone was used instead of the masterbatch of the wax dispersant (A), and C.I. Pigment Red 122 alone was used as a colorant with an amount of 1.2 part by mass, to thereby obtain a magenta developer a-14. The magenta developer a-14 was evaluated similarly to Example 1. As shown in Table 8, roughness of the obtained image in low-density region was very large, and the fixing temperature range width and transparency on an OHP sheet were poor compared to those of Example 1.

Example 12

A magenta toner b-1 (deep) was prepared similar to Example 1 except that C.I. Pigment Red 122 alone was used as a colorant with an amount of 5.0 parts by mass. Reflectance of the magenta toner b-1 in a powder form measured using light at a wavelength of 480 nm was 4.9%, and reflectance of the magenta toner b-1 in a powder form measured using light at a wavelength of 630 nm was 56.4%. An L* value of the magenta toner b-1 in a powder form was 38.0.

The magenta toner b-1 and ferrite carrier (average particle size of 42 μm) with its surface coated with a silicone resin were mixed so that toner concentration was 6% by mass, to thereby obtain a magenta developer b-1 (deep).

For Examples 1 to 11, roughness was evaluated for images with an optical density of about 0.35 when the pale magenta developer alone was used. On the other hand, the pale magenta developer and the deep magenta developer were used in Example 12, enabling reproduction of higher image density. Therefore, roughness of an image in a halftone region with an optical density of about 0.80, hardly attained with the pale magenta developer alone, was evaluated. Hereinafter, evaluation method will be described.

In a commercially-available plain paper full-color copier (Color Laser Copier "CLC1150", manufactured by Canon Inc.), the magenta developer a-1 containing the magenta toner a-1 was charged in the cyan developing unit and the magenta developer b-1 containing the magenta toner b-1 was charged in the magenta developing unit. A patch image overlapping a 16-gradation pale magenta toner image and a 16-gradation deep magenta toner image with an image pattern obtained by rotating the image pattern of the pale magenta toner by 90 degrees was formed in a printer mode, using plain paper (Color Laser Copier Paper "TKCLA4", available from Canon Inc.).

Roughness of the image obtained using the pale magenta developer and the deep magenta cyan developer in combination was evaluated according to rank based on the following criteria.

A: below 32.0 (no roughness at all, very low graininess)
B: 32.1 to 34.0 (practically no roughness, low graininess)
C: 34.1 to 36.0 (slight roughness, graininess not posing problems in practical use)
D: 36.1 to 38.0 (apparent roughness, high graininess)
E: 38.1 or above (much roughness, very high graininess)

Roughness of the patch image at an optical density of about 0.80 obtained using a combination of the magenta toner a-1, a pale toner, and the magenta toner b-1, a deep toner, was measured for Example 12. Table 7 shows that the combined toner had slightly poor transparency on an OHP sheet, fixing temperature range width, and chroma compared to those of the pale toner alone, but will not pose problems in practical use. The image overlaying two colors resulted in a roughness value of 30.3 at an optical density of about 0.80. The result is much better than the magenta toner b-1 alone at an optical density of about 0.80, having a roughness value of 42.9.

Figure 11:
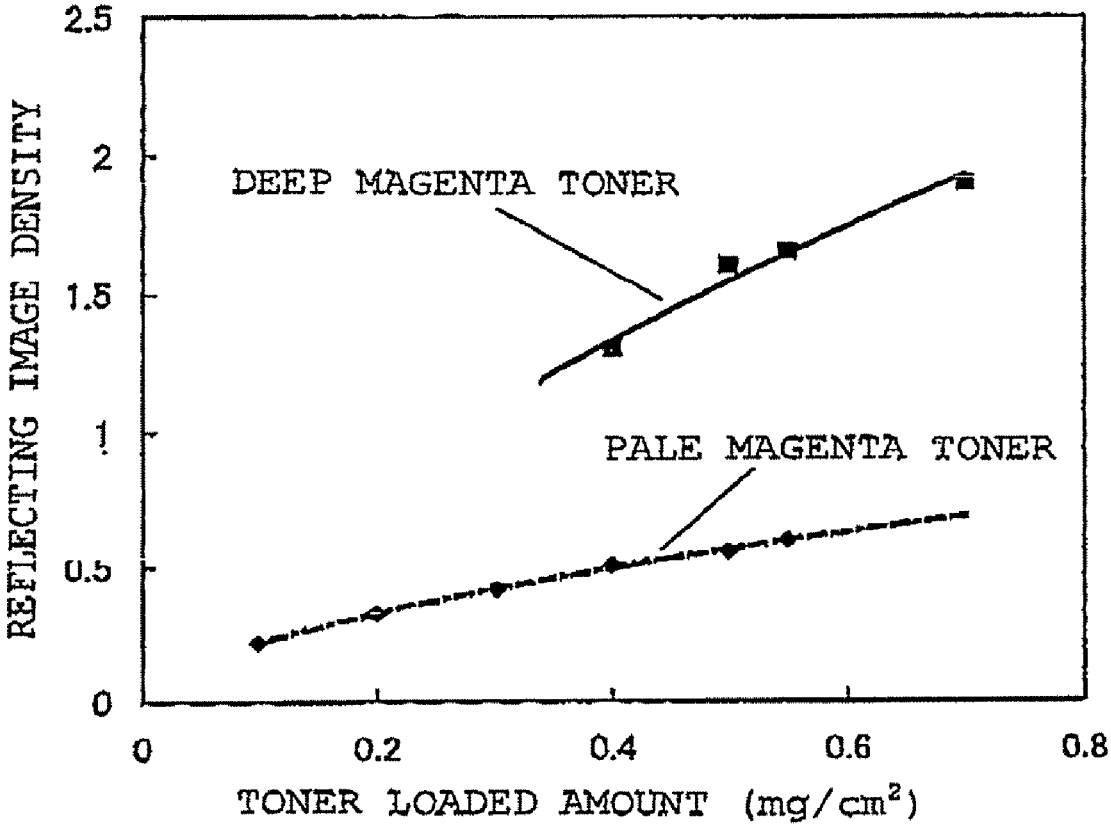
FIG. 11 is a diagram showing a relationship between a toner amount loaded of a fixed image and a reflecting image density of the fixed image when each of a deep magenta toner b-1 and a pale magenta toner a-1 is used singly according to an example of the present invention.

The combined use of a deep magenta developer and a pale magenta developer enables an image which has suppressed roughness and which is excellent in halftone color reproduction to be obtained. FIG. 11 shows a relationship between an amount of toner loaded on a fixed image when the deep magenta toner b-1 and the pale magenta toner a-1 are used independently and an optical image density of the fixed image.

Examples 13 to 22

Evaluation was performed similarly to Example 12 except that the magenta developers a-2 to a-11 were used as pale magenta developers instead of the magenta developer a-1 as shown in Table 7.

Table 7 shows that the developers had increased roughness, poor transparency on an OHP sheet, poor fixing temperature range width, and poor chroma at an optical density of about 0.80 compared to those of Example 12, but not posing any problems in practical use.

Example 23

A magenta toner b-2 was prepared similar to Example 1 except that C.I. Pigment Red 122 alone was used as a colorant with an amount of 8.0 parts by mass. Reflectance of the magenta toner b-2 in a powder form measured using light at a wavelength of 480 nm was 3.8%, and reflectance of the magenta toner b-2 in a powder form measured using light at a wavelength of 630 nm was 51.7%. An L* value of the magenta toner b-2 in a powder form was 32.5. A patch image similar to that in Example 12 was formed using the magenta developer b-2 and the magenta developer a-1.

The patch image was evaluated similarly to Example 12. Table 7 shows that the patch image had poor transparency on an OHP sheet, fixing temperature range width, and chroma compared to those of the image obtained using the pale toner alone, but not posing any problems in practical use. Roughness of the image obtained using two colors overlaying was 33.8, which is within a practical level.

Example 24

A magenta toner b-3 was prepared similar to Example 1 except that C.I. Pigment Red 122 alone was used as a colorant with an amount of 3.0 parts by mass. Reflectance of the magenta toner b-3 in a powder form measured using light at a wavelength of 480 nm was 13.5%, and reflectance of the magenta toner b-3 in a powder form measured using light at a wavelength of 630 nm was 64.5%. An L* value of the magenta toner b-3 in a powder form was 43.8. A patch image similar to that in Example 12 was formed using the magenta developer b-3 and the magenta developer a-1.

The patch image was evaluated similarly to Example 12. Table 7 shows that the patch image had poor transparency on an OHP sheet, fixing temperature range width, and chroma compared to those of the image obtained using the pale toner alone, but not posing any problems in practical use. Roughness of the image obtained using two colors overlaying was 33.2, which is within a practical level.

Example 25

A patch image similar to that in Example 12 was formed using the magenta developer a-7 and the magenta developer b-1.

The patch image was evaluated similarly to Example 12. Table 7 shows that the patch image had poor transparency on an OHP sheet, fixing temperature range width, and chroma compared to those of the image obtained using the pale toner alone, but not posing any problems in practical use. Roughness of the image obtained using two colors overlaying was 34.9, which is within a practical level.

Example 26

A patch image similar to that in Example 12 was formed using the magenta developer a-8 and the magenta developer b-2.

The patch image was evaluated similarly to Example 12. Table 7 shows that the patch image had poor transparency on an OHP sheet, fixing temperature range width, and chroma compared to those of the image obtained using the pale toner alone, but not posing any problems in practical use. Roughness of the image obtained using two colors overlaying was 35.8, which is above a lower limit of a practical level.

Example 27

Evaluation was performed by a one-component developing method using the magenta toner a-1 and the magenta toner b-1. A device remodeled by removing a fixing unit of LBP-2040 (manufactured by Canon Inc.) was used as an image forming apparatus, and fixing was conducted using an external fixing device similar to that of Example 1. Evaluation was performed similarly to Example 12. Table 7 shows that the image obtained had no problems in transparency on an OHP sheet, fixing temperature range width, and chroma as the image in Example 12. Roughness of the image obtained using two colors overlaying war 31.1, equal to that of the image formed by a two-component developing method.

Comparative Example 4

A magenta toner b-4 was prepared similar to Example 1 except that the wax (D) alone was used instead of the masterbatch containing the wax (A) and the wax dispersant (I) and C.I. Pigment Red 122 alone was used as a colorant with an amount of 2.2 parts by mass. Reflectance of the magenta toner b-4 in a powder form measured using light at a wavelength of 480 nm was 14.5%, and reflectance of the magenta toner b-4 in a powder form measured using light at a wavelength of 630 nm was 64.8%. An L* value of the magenta toner b-4 in a powder form was 44.7. A patch image similar to that of Example 12 was formed using the magenta developer b-4 and the magenta developer a-4. A difference in L* value between the pale magenta toner a-4 and the deep magenta toner b-4 was as small as 6.0. The patch image was evaluated similarly to Example 12. As shown in Table 8, roughness of the image at the medium-density region (density of about 0.80) was measured, resulting in a very bad value of 37.9 with two colors overlaid. Thus, the total amount of the toner loaded was also large, resulting in a very narrow fixing temperature range width.

Comparative Example 5

A magenta toner b-5 was prepared similar to Example 1 except that the wax (D) alone was used instead of the masterbatch of the wax dispersant (I) and C.I. Pigment Red 122 alone was used as a colorant with an amount of 9.0 parts by mass. Reflectance of the magenta toner b-5 in a powder form measured using light at a wavelength of 480 nm was 3.2%, and reflectance of the magenta toner b-5 in a powder form measured using light at a wavelength of 630 nm was 49.8%. An L* value of the magenta toner b-5 in a powder form was 31.8.

A patch image similar to that of Example 12 was formed using the magenta developer b-5 and the magenta developer a-1. A difference in L* value between the pale magenta toner a-1 and the deep magenta toner b-5 was as large as 34.4. The patch image was evaluated similarly to Example 12. As shown in Table 8, roughness of the image at the medium-density region (density of about 0.80) was measured, resulting in a very bad value of 38.8 with two colors overlaid. Further, transparency on an OHP sheet and chroma were also very poor.

Comparative Example 6

A patch image similar to that of Example 12 was formed using the magenta developer a-6 and the magenta developer b-3. A difference in L* value between the pale magenta toner a-6 and the deep magenta toner b-3 was as small as 6.1. The patch image was evaluated similarly to Example 12. As shown in Table 8, roughness of the image at the medium-density region (density of about 0.80) was measured, resulting in a very bad value of 38.2 with two colors overlaid. The total amount of the toner loaded was also large, resulting in a very narrow fixing temperature range width. Further, transparency on an OHP sheet and chroma were also very poor.

TABLE 4

| Toner No. | Binder resin Kind | Wax (Wax dispersant) Kind | Maximum heat-absorption peak temperature (° C.) | Average circularity |
|---|---|---|---|---|
| Magenta toner a-1 | Hybrid resin (I) | Wax dispersant masterbatch containing wax (A) and wax dispersion medium (I) | 76 | 0.929 |
| Magenta toner a-2 | Hybrid resin (I) | Wax dispersant masterbatch containing wax (F) and wax dispersion medium (II) | 68 | 0.930 |
| Magenta toner a-3 | Hybrid resin (I) | Wax dispersant masterbatch containing wax (G) and wax dispersion medium (III) | 103 | 0.932 |
| Magenta toner a-4 | Hybrid resin (I) | Wax dispersant masterbatch containing wax (B) and wax dispersion medium (I) | 99 | 0.931 |
| Magenta toner a-5 | Hybrid resin (I) | Wax (A) | 79 | 0.941 |
| Magenta toner a-6 | Polyester resin (I) | Wax dispersant masterbatch containing wax (A) and wax dispersion medium (IV) | 78 | 0.939 |
| Magenta toner a-7 | Hybrid resin (I): Vinyl resin (I) = 7:3 | Wax (B) | 98 | 0.934 |
| Magenta toner a-8 | Hybrid resin (I): Polyester resin (I) = 1:1 | Wax (C) | 86 | 0.926 |
| Magenta toner a-9 | Vinyl resin (I) | Wax dispersant masterbatch containing wax (A) and wax dispersion medium (I) | 77 | 0.942 |
| Magenta toner a-10 | Polyester resin (I): Vinyl resin (I) = 7:3 | Wax dispersant masterbatch containing wax (A) and wax dispersion medium (II) | 78 | 0.941 |
| Magenta toner a-11 | Hybrid resin (I): Polyester resin (I): Vinyl resin (I) = 5:3:2 | Wax dispersant masterbatch containing wax (A) and wax dispersion medium (I) | 79 | 0.923 |

| Toner No. | Colorant Kind | Colorant Content (parts by mass) | Colorant Ratio of particles having dispersion sizes of 0.05 to 0.5 μm (number %) |
|---|---|---|---|
| Magenta toner a-1 | C.I.Pig.Red 122/ C.I.Pig.Red 57:1 | 0.6/0.1 | 81.1 |
| Magenta toner a-2 | C.I.Pig.Red 122/ C.I.Pig.Red 57:1 | 0.6/0.1 | 78.7 |
| Magenta toner a-3 | C.I.Pig.Red 122/ C.I.Pig.Red 57:1 | 0.6/0.1 | 79.5 |
| Magenta toner a-4 | C.I.Pig.Red 122/ C.I.Pig.Red 57:1 | 0.8/0.1 | 78.1 |
| Magenta toner a-5 | C.I.Pig.Red 122 | 0.7 | 69.9 |
| Magenta toner a-6 | C.I.Pig.Red 122 | 1.8 | 74.9 |
| Magenta toner a-7 | C.I.Pig.Red 122/ C.I.Pig.Red 57:1 | 0.6/0.1 | 72.5 |
| Magenta toner a-8 | C.I.Pig.Red 122 | 0.7 | 70.3 |
| Magenta toner a-9 | C.I.Pig.Red 122/ C.I.Pig.Yellow 180 | 0.3/0.1 | 71.9 |
| Magenta toner a-10 | C.I.Pig.Red 122/ C.I.Pig.Blue 15:3 | 0.6/0.1 | 72.9 |
| Magenta toner a-11 | C.I.Pig.Red 122/ C.I.Pig.Red 57:1 | 0.6/0.1 | 79.8 |

TABLE 5

| Toner No. | Binder resin Kind | Wax (Wax dispersant) Kind | Maximum heat-absorption peak temperature (° C.) | Average circularity |
|---|---|---|---|---|
| Magenta toner a-12 | Polyester resin (II) | Wax (D) | 111 | 0.917 |
| Magenta toner a-13 | Polyester resin (III) | Wax (E) | 63 | 0.949 |

TABLE 5-continued

| | | | | |
|---|---|---|---|---|
| Magenta toner a-14 | Hybrid resin (I) | Wax (D) | 110 | 0.935 |
| Magenta toner b-1 | Hybrid resin (I) | Wax dispersant masterbatch containing wax (A) and wax dispersion medium (I) | 76 | — |
| Magenta toner b-2 | Hybrid resin (I) | Wax dispersant masterbatch containing wax (A) and wax dispersion medium (I) | 79 | — |
| Magenta toner b-3 | Hybrid resin (I) | Wax dispersant masterbatch containing wax (A) and wax dispersion medium (I) | 77 | — |
| Magenta toner b-4 | Hybrid resin (I) | Wax (D) | 113 | — |
| Magenta toner b-5 | Hybrid resin (I) | Wax (D) | 112 | — |

| | Colorant | | |
|---|---|---|---|
| Toner No. | Kind | Content (parts by mass) | Ratio of particles having dispersion sizes of 0.05 to 0.5 μm (number %) |
| Magenta toner a-12 | C.I.Pig.Red 122 | 0.4 | 66.8 |
| Magenta toner a-13 | C.I.Pig.Red 122 | 0.4 | 65.3 |
| Magenta toner a-14 | C.I.Pig.Red 122 | 1.2 | 44.9 |
| Magenta toner b-1 | C.I.Pig.Red 122 | 5.0 | 80.5 |
| Magenta toner b-2 | C.I.Pig.Red 122 | 8.0 | 80.2 |
| Magenta toner b-3 | C.I.Pig.Red 122 | 3.0 | 72.8 |
| Magenta toner b-4 | C.I.Pig.Red 122 | 2.2 | 44.5 |
| Magenta toner b-5 | C.I.Pig.Red 122 | 9.0 | 42.8 |

TABLE 6

| | Measurements of spectral sensitivity distribution of toner in a powder form | | | Viscoelastic properties of toner (Pa) | | Deformation rate of toner (%) | |
|---|---|---|---|---|---|---|---|
| Toner No. | Reflectance at 480 nm (%) | Reflectance at 630 nm (%) | L* | G' 120 | G' 180 | R200 | R500 |
| Magenta toner a-1 | 28.8 | 79.2 | 60.3 | $2.47 \times 10^4$ | 98 | 55.3 | 72.1 |
| Magenta toner a-2 | 29.1 | 77.7 | 61.3 | $2.09 \times 10^4$ | 87 | 57.6 | 74.6 |
| Magenta toner a-3 | 30.2 | 80.1 | 60.4 | $3.32 \times 10^4$ | 122 | 51.4 | 70.6 |
| Magenta toner a-4 | 27.6 | 75.9 | 61.3 | $2.78 \times 10^4$ | 104 | 55.3 | 70.9 |
| Magenta toner a-5 | 28.5 | 77.9 | 67.8 | $2.58 \times 10^4$ | 98 | 52.9 | 72.9 |
| Magenta toner a-6 | 29.5 | 74.9 | 49.9 | $1.40 \times 10^3$ | 23 | 63.1 | 82.3 |
| Magenta toner a-7 | 24.2 | 78.6 | 60.3 | $6.88 \times 10^4$ | 2,720 | 46.2 | 66.5 |
| Magenta toner a-8 | 29.8 | 77.2 | 59.9 | $1.29 \times 10^4$ | 65 | 58.6 | 77.2 |
| Magenta toner a-9 | 40.5 | 88.2 | 67.3 | $8.63 \times 10^4$ | 3,260 | 45.8 | 65.3 |
| Magenta toner a-10 | 43.0 | 67.5 | 59.8 | $5.28 \times 10^4$ | 1,968 | 52.3 | 72.8 |
| Magenta toner a-11 | 28.3 | 75.8 | 63.9 | $3.10 \times 10^4$ | 105 | 58.0 | 74.9 |
| Magenta toner a-12 | 28.9 | 72.5 | 76.8 | $1.06 \times 10^4$ | 5,120 | 42.0 | 63.1 |
| Magenta toner a-13 | 28.9 | 77.5 | 76.5 | $3.00 \times 10^2$ | 8 | 68.1 | 87.1 |
| Magenta toner a-14 | 18.8 | 69.8 | 70.4 | $2.68 \times 10^4$ | 104 | 58.6 | 79.6 |

TABLE 6-continued

| Toner No. | Measurements of spectral sensitivity distribution of toner in a powder form: Reflectance at 480 nm (%) | Reflectance at 630 nm (%) | L* | Viscoelastic properties of toner (Pa): G' 120 | G' 180 | Deformation rate of toner (%): R200 | R500 |
|---|---|---|---|---|---|---|---|
| Magenta toner b-1 | 4.9 | 56.4 | 38.0 | $2.92 \times 10^4$ | 122 | 52.9 | 71.5 |
| Magenta toner b-2 | 3.8 | 51.7 | 32.5 | $3.00 \times 10^4$ | 135 | 67.2 | 69.9 |
| Magenta toner b-3 | 13.5 | 64.5 | 43.8 | $2.00 \times 10^4$ | 88 | 59.6 | 76.8 |
| Magenta toner b-4 | 14.5 | 64.8 | 44.7 | $2.59 \times 10^4$ | 103 | 53.3 | 76.5 |
| Magenta toner b-5 | 3.2 | 49.8 | 31.8 | $2.88 \times 10^4$ | 148 | 59.8 | 72.8 |

TABLE 7

| | | Roughness: Optical density of around 0.35 | Optical density of around 0.80 | L*(a) − L*(b) | Fixing temperature region | Transparency on an OHP sheet (%) | c* at L* = 80 |
|---|---|---|---|---|---|---|---|
| Example 1 | Magenta developer a-1 | A (20.1) | — | — | 120° C.~200° C. | A (85.8) | A (29.2) |
| Example 2 | Magenta developer a-2 | A (20.3) | — | — | 115° C.~180° C. | A (84.5) | A (29.4) |
| Example 3 | Magenta developer a-3 | A (20.4) | — | — | 130° C.~205° C. | A (82.9) | A (29.9) |
| Example 4 | Magenta developer a-4 | A (21.1) | — | — | 135° C.~200° C. | A (79.8) | A (29.8) |
| Example 5 | Magenta developer a-5 | B (23.2) | — | — | 120° C.~200° C. | B (69.1) | A (29.4) |
| Example 6 | Magenta developer a-6 | C (25.3) | — | — | 125° C.~200° C. | C (58.1) | B (28.2) |
| Example 7 | Magenta developer a-7 | B (23.1) | — | — | 135° C.~190° C. | B (65.1) | C (26.1) |
| Example 8 | Magenta developer a-8 | C (24.8) | — | — | 135° C.~180° C. | C (57.8) | C (25.9) |
| Example 9 | Magenta developer a-9 | C (24.2) | — | — | 125° C.~190° C. | C (52.1) | C (25.8) |
| Example 10 | Magenta developer a-10 | C (24.5) | — | — | 125° C.~190° C. | B(63.9) | B (28.1) |
| Example 11 | Magenta developer a-11 | C (24.9) | — | — | 125° C.~190° C. | C (52.8) | C (25.2) |
| Example 12 | Magenta developer a-1/b-1 | — | A (30.3) | 22.3 | 135° C.~185° C. | A (78.9) | B (28.9) |
| Example 13 | Magenta developer a-2/b-1 | — | A (30.6) | 23.3 | 125° C.~170° C. | A (76.5) | B (28.3) |
| Example 14 | Magenta developer a-3/b-1 | — | A (30.2) | 22.4 | 145° C.~200° C. | A (76.9) | B (28.9) |
| Example 15 | Magenta developer a-4/b-1 | — | A (31.9) | 23.3 | 145° C.~200° C. | A (73.5) | A (29.5) |
| Example 16 | Magenta developer a-5/b-1 | — | B (33.1) | 29.8 | 130° C.~190° C. | B (63.8) | A (29.4) |
| Example 17 | Magenta developer a-6/b-1 | — | C (35.5) | 11.9 | 130° C.~190° C. | C (51.9) | B (28.5) |
| Example 18 | Magenta developer a-7/b-1 | — | B (33.9) | 22.3 | 145° C.~180° C. | B (60.3) | C (26.9) |
| Example 19 | Magenta developer a-8/b-1 | — | C (34.8) | 21.9 | 145 ° C.~175° C. | C (51.8) | C (25.5) |
| Example 20 | Magenta developer a-9/b-1 | — | C (34.9) | 29.3 | 135° C.~180° C. | C (50.4) | C (25.8) |
| Example 21 | Magenta developer a-10/b-1 | — | C (34.1) | 21.8 | 135° C.~180° C. | C (58.8) | B (28.1) |
| Example 22 | Magenta developer a-11/b-1 | — | C (34.8) | 25.9 | 140° C.~180° C. | C (50.8) | C (25.4) |
| Example 23 | Magenta developer a-1/b-2 | — | B (33.8) | 22.3 | 135° C.~185° C. | B (69.5) | B (27.1) |
| Example 24 | Magenta developer a-1/b-3 | — | B (33.2) | 16.5 | 125° C.~185° C. | B (69.8) | B (27.4) |

TABLE 7-continued

| | | Roughness | | | Fixing | Transparency | |
|---|---|---|---|---|---|---|---|
| | | Optical density of around 0.35 | Optical density of around 0.80 | L*(a) − L*(b) | temperature region | on an OHP sheet (%) | c* at L* = 80 |
| Example 25 | Magenta developer a-7/b-1 | — | C (34.9) | 16.5 | 135° C.~185° C. | B (62.8) | C (26.9) |
| Example 26 | Magenta developer a-8/b-2 | — | C (35.8) | 27.4 | 130° C.~180° C. | C (55.1) | C (25.5) |
| Example 27 | Magenta developer a-1/b-1 | — | A (31.1) | 22.3 | 135° C.~185° C. | B (68.4) | B(27.4) |

TABLE 8

| | | Roughness | | | Fixing | Transparency | |
|---|---|---|---|---|---|---|---|
| | | Optical density of around 0.35 | Optical density of around 0.80 | L*(a) − L*(b) | temperature region | on an OHP sheet (%) | c* at L* = 80 |
| Comparative Example 1 | Magenta developer a-12 | D (27.9) | — | — | 155° C.~170° C. | D (44.6) | D (23.5) |
| Comparative Example 2 | Magenta developer a-13 | E (33.8) | — | — | 130° C.~175° C. | B (69.1) | C (26.1) |
| Comparative Example 3 | Magenta developer a-14 | E (34.1) | — | — | 160° C.~175° C. | D (42.4) | D (23.4) |
| Comparative Example 4 | Magenta developer a-4/b-4 | — | D (37.9) | 16.6 | 160° C.~175° C. | C (51.9) | C (25.9) |
| Comparative Example 5 | Magenta developer a-1/b-5 | — | E (38.8) | 28.5 | 135° C.~180° C. | E (39.6) | C (25.5) |
| Comparative Example 6 | Magenta developer a-6/b-3 | — | E (38.2) | 6.1 | 165° C.~170° C. | E (35.2) | E (22.3) |

Example 28

In Example 28, an image was formed using a full-color electrophotography device shown in FIG. 6 with a combination of the developing units and the developers represented in (a) to (c) below, and significant differences among the combinations of the developers represented by (a) to (c) at that time were investigated.

(a): The deep magenta developer (magenta developer b-1 used in Example 11) was set in a developing unit 411*a*. A cyan developer, containing 6.0 parts by mass of C.I. Pigment Blue 15:3 added, instead of the colorant in Example 1 was set in a developing unit 412. A yellow developer, containing 8.0 parts by mass of C.I. Pigment Yellow 180 added, instead of the colorant in Example 1 was set in a developing unit 413. A black developer, containing 4.0 parts by mass of carbon black added, instead of the colorant in Example 1 was set in a developing unit 414.

(b): The deep magenta developer (magenta developer b-1) was set in the developing unit 411*a*. The pale magenta developer (magenta developer a-1) was set in a developing unit 411*b*. The above cyan developer was set in the developing unit 412. The above yellow developer was set in the developing unit 413. The above black developer was set in the developing unit 414.

(c): The pale magenta developer (magenta developer a-1) was set in the developing unit 411*b*. The above cyan developer was set in the developing unit 412. The above yellow developer was set in the developing unit 413. The above black developer was set in the developing unit 414.

As a result, a vivid image was obtained using combination (b) having suppressed graininess and roughness across the whole region from the low-density region to the high-density region and exhibiting high chroma compared to the image obtained using combination (a). On the other hand, an image obtained using combination (c) had reduced graininess in the low-density region and increased color reproduction range, but had reduced chroma from the medium-density region to the high-density region. Further, combination (c) resulted in an image with increased graininess in the medium-density region compared to the image obtained using combination (a). That is, the effect of the present invention was also sufficiently exhibited for the full-color electrophotography device as in Example 28 by using the pale magenta toner and the deep magenta toner within the scope of the present invention.

The invention claimed is:

1. A method for forming an image, comprising: forming a first electrostatic charge image on an electrostatic charge image bearing member;

forming a first magenta toner image by developing the first electrostatic charge image with a first magenta toner;

transferring the first magenta toner image to a transfer material through an intermediate transfer member or directly;

forming a second electrostatic charge image on the electrostatic charge image bearing member;

forming a second magenta toner image by developing the second electrostatic charge image with a second magenta toner;

transferring the second magenta toner image to the transfer material through the intermediate transfer member or directly; and fixing the first magenta toner image and the second magenta toner image on the transfer material under heating and pressure to form a fixed image on the transfer material, wherein;

the first magenta toner comprises one of a pale magenta toner and a deep magenta toner; and the second magenta toner comprises the other of the pale magenta toner and the deep magenta toner; and the pale magenta toner comprises magenta toner particles which comprises at least a binder resin, a colorant, and a wax, has one or plural heat-absorption peaks in a temperature range of 30 to 200° C. in a heat-absorption curve obtained using a differential scanning calorimeter, has 0.2 to 1.8 parts by weight of the colorant per 100 parts by weight of the binder resin, has a maximum value of a maximum heat-absorption peak temperature in the one or plural heat-absorption peaks in a range of 65 to 105° C., has a reflectance of 15 to 45% at a wavelength of 480 nm and a reflectance of 65 to 90% at a wavelength of 630 nm when measured using the magenta toner in a powder form by spectroscopic analysis, has a storage elastic modulus ($G^1120$) of $5\times10^2$ to $1\times10^5$ Pa at a temperature of 120° C. and a storage elastic modulus ($G^1180$) of 10 to $5\times10^3$ Pa at a temperature of 180° C., and has a lightness L* of 45 to 75 when measured in a powder form.

2. The method for forming an image according to claim 1, wherein L* (a) representing a lightness L* of the pale magenta toner and L* (b) representing a lightness L* of the deep magenta toner satisfy a relationship of:

$$10 \leqq L^*(a) - L^*(b) \leqq 30.$$

3. A method for forming a full-color image, comprising forming a first electrostatic charge image on an electrostatic charge image bearing member;

forming a first toner image by developing the first electrostatic charge image with a first toner selected from group consisting of a cyan toner, a yellow toner; a pale magenta toner, a deep magenta toner, and a black toner;

transferring the first toner image to a transfer material through an intermediate transfer member or directly;

forming a second electrostatic charge image on the electrostatic charge image bearing member;

forming a second toner image by developing the second electrostatic charge image with a second toner selected from the group consisting of a cyan toner, a yellow toner, a pale magenta toner, a deep magenta toner, and a black toner and excluding the first toner; transferring the second toner image to the transfer material through the intermediate transfer member or directly;

forming a third electrostatic charge image on the electrostatic charge image bearing member;

forming a third toner image by developing the third electrostatic charge image with a third toner selected from the group consisting of a cyan toner, a yellow toner, a pale magenta toner, a deep magenta toner, and a black toner and excluding the first toner and the second toner;

transferring the third toner image to the transfer material through the intermediate transfer member or directly;

forming a fourth electrostatic charge image on the electrostatic charge image bearing member;

forming a fourth toner image by developing the fourth electrostatic charge image with a fourth toner selected from the group consisting of a cyan toner, a yellow toner, a pale magenta toner, a deep magenta toner, and a black toner and excluding the first to third toners; transferring the fourth toner image to the transfer material through the intermediate transfer member or directly;

forming a fifth electrostatic charge image on the electrostatic charge image bearing member;

forming a fifth toner image by developing the fifth electrostatic charge image with a fifth toner selected from the group consisting of a cyan toner, a yellow toner, a pale magenta, a deep magenta toner, and a black toner and excluding the first to fourth toners; transferring the fifth toner image to the transfer material through the intermediate transfer member or directly; and forming an image by fixing under heating and pressure the transfer material on which toner images of the cyan toner, the yellow toner, the pale magenta toner, the deep magenta toner, and the black toner are formed, wherein the pale magenta toner comprises magenta toner particles which comprises at least a binder resin, a colorant, and a wax, has one or plural heat-absorption peaks in a temperature range of 30 to 200° C. in a heat-absorption curve obtained using a differential scanning calorimeter, has a maximum value of a maximum heat-absorption peak of the one or plural heat-absorption peaks in a range of 65 to 105° C., has a reflectance of 15 to 45% at a wavelength of 480 rim and a reflectance of 65 to 90% at a wavelength of 630 nm when measured using the magenta toner in a powder form by spectroscopic analysis, has 0.2 to 1.8 parts by weight of the colorant per 100 parts by weight of the binder resin, has a storage elastic modulus ($G^1120$) of $5\times10^2$ to $1\times10^5$ Pa at a temperature of 120° C. and a storage elastic modulus ($G^1180$) of 10 to $5\times10^3$ Pa at a temperature of 180° C. and has a lightness L* of 45 to 75 when measured in a powder form.

4. The method for forming a full-color image according to claim 3, wherein L* (a) representing L* of the pale magenta toner and L* (b) representing L* of the deep magenta toner satisfy a relationship of:

$$10 \leqq L^*(a) - L^*(b) \leqq 30.$$

5. The method for forming a full-color image according to claim 3, wherein the yellow toner comprises C.I. Pigment Yellow 74 as a colorant.

* * * * *